US006480163B1

(12) United States Patent
Knop et al.

(10) Patent No.: US 6,480,163 B1
(45) Date of Patent: Nov. 12, 2002

(54) RADIATING COAXIAL CABLE HAVING HELICALLY DIPOSED SLOTS AND RADIO COMMUNICATION SYSTEM USING SAME

(75) Inventors: Charles M. Knop; Gregory S. Orseno, both of Lockport, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/465,360

(22) Filed: Dec. 16, 1999

(51) Int. Cl.[7] ..... H01Q 13/10
(52) U.S. Cl. ..... 343/770; 343/771; 333/237
(58) Field of Search ..... 343/767, 768, 343/770, 771, 790, 791; 333/236, 237, 239; 455/523

(56) References Cited

U.S. PATENT DOCUMENTS

| | | | | | |
|---|---|---|---|---|---|
| 2,574,433 | A | | 11/1951 | Clapp | 343/771 |
| 2,971,193 | A | | 2/1961 | Siukola | 343/770 |
| 3,031,666 | A | | 4/1962 | Butler | 343/771 |
| 3,106,713 | A | * | 10/1963 | Murata et al. | 333/237 |
| 3,648,172 | A | | 3/1972 | Nakahara et al. | 333/237 X |
| 3,691,488 | A | | 9/1972 | Holtum, Jr. | 333/237 |
| 3,781,725 | A | | 12/1973 | Yoshida et al. | 343/771 |
| 3,795,915 | A | * | 3/1974 | Yoshida | 333/237 |
| 3,909,757 | A | | 9/1975 | Miyamoto et al. | 343/770 X |
| 3,963,999 | A | | 6/1976 | Nakajima et al. | 333/237 |
| 4,280,225 | A | | 7/1981 | Willis | 455/55.1 |
| 4,322,699 | A | | 3/1982 | Hildebrand et al. | 333/237 |
| 4,334,229 | A | | 6/1982 | Boblett | 343/767 |
| 4,339,733 | A | | 7/1982 | Smith | 333/237 |
| 4,366,457 | A | | 12/1982 | Bode et al. | 333/237 |
| 4,599,121 | A | | 7/1986 | Edwards et al. | 156/48 |
| 4,625,187 | A | | 11/1986 | Bocher | 333/237 |
| 4,660,007 | A | | 4/1987 | Edwards et al. | 333/237 |
| 4,788,552 | A | | 11/1988 | Karisson | 343/771 |
| 4,800,351 | A | | 1/1989 | Rampalli et al. | 333/237 |
| 4,821,044 | A | | 4/1989 | Kurtz | 343/771 |
| 4,873,528 | A | | 10/1989 | Girard | 343/770 |
| 5,291,164 | A | | 3/1994 | Levisse | 333/237 |
| 5,414,437 | A | | 5/1995 | Mahnad | 343/770 |
| 5,432,838 | A | | 7/1995 | Purchase et al. | 379/55 |
| 5,546,096 | A | * | 8/1996 | Wada | 343/770 |
| 5,705,967 | A | * | 1/1998 | Pirard | 333/237 |
| 5,717,411 | A | | 2/1998 | Knop et al. | 343/771 |
| 5,809,429 | A | | 9/1998 | Knop et al. | 455/523 |
| 5,898,350 | A | * | 4/1999 | Aberasturi | 333/237 |

FOREIGN PATENT DOCUMENTS

| | | | |
|---|---|---|---|
| DE | 26 28 755 | 1/1978 | H01Q/21/06 |
| EP | 0 300 147 | 1/1989 | H01Q/13/20 |
| FR | 8201456 | 1/1982 | |
| GB | 696659 | 9/1953 | |
| GB | 739618 | 11/1955 | 343/770 |
| GB | 1156450 | 6/1969 | |
| GB | 1324180 | 7/1973 | 343/770 |
| JP | 56811 | 5/1977 | 455/55.1 |
| JP | 89136 | 5/1985 | 455/41 |
| JP | 62-295525 | 12/1987 | |
| JP | 63-287104 | 11/1988 | |
| JP | 2-288604 | 11/1990 | |

OTHER PUBLICATIONS

Martin, D.J.R. "Radio Communication in Mines," The Mining Engineer; Dec. 1977 Jan. 1978 issue; pp. 275–282.

(List continued on next page.)

*Primary Examiner*—Tan Ho
(74) *Attorney, Agent, or Firm*—Jenkens & Gilchrist

(57) ABSTRACT

A radiating coaxial cable having a longitudinal axis comprises an inner conductor having a longitudinal axis wherein the axis of the inner conductor defines the axis of the cable. A dielectric material surrounds the inner conductor. A continuous outer conductor surrounds the dielectric in direct contact therewith and is spaced from the inner conductor. The outer conductor has a plurality of slots disposed therein. Adjacent slots are spaced in the axial direction a distance S. One or more adjacent slots are grouped together in a cell. The cable has a plurality of cells. Adjacent cells are angularly disposed from each other by an angle α.

45 Claims, 20 Drawing Sheets

OTHER PUBLICATIONS

*Electrical Communications*, Jan. 1, 1994; pp. 66–73; A. Levisse; "Radiating Cables–Channel Tunnel Applications".
Gale DJ, and Beal JC, Comparative Testing of Leaky Coaxial Cables for Communications and Guided Radar, *IEE Trans. MTT*; 1980; vol. MTT–28, No. 9, 1006–1013, no month.
Sako T. Misawa S. Naruse T, Yasuhara H, Oguchi M and Kato T. Leaky Coaxial Cable, *Fujikura Technical Review*, 1974; 26–39.
Ries E and Cuccia C. Status Report: Communications in Mass Transit Guided–Roadway Systems, *Microwave systems News*, 1975; 24–42 no month.
Milligan TA, *Modern Antenna Design*, McGraw–Hill Book Co., NY. 1985; 92–93.
Aihara K, Sakata Y and Tago N, Ultra–High–Bandwidth Heat Resistant Leaky Coaxial Cable; *Intl. Wire & Cable Symp Proc*, 1992; 732–738.
Levisse A; Leaky or Radiating? Radiation Mechanisms of Radiating Cables and Leaky Feeders–Channel Tunnel Applications; *Int. Wire & Cable Symp Proc*; 1992; 739–747.
Coraiola A, Haag HG. Schulze–Buxloh and Thonnessen G; Leaky Coaxial Cable With Length Independent Antenna Receiving Level; *Int. Wire & Cable Symp Proc*; 1992; 748–756.

* cited by examiner-

RADIATING COAXIAL CABLE HAVING HELICALLY DIPOSED SLOTS AND RADIO COMMUNICATION SYSTEM USING SAME

FIELD OF THE INVENTION

The present invention relates generally to radiating transmission lines, particularly coaxial cables having helically disposed slots, and to radio communication systems that use such radiating transmission lines.

BACKGROUND OF THE INVENTION

Radiating coaxial cable has been used for many years in various types of radio communication systems. An improved radiating cable is disclosed in commonly-owned U.S. Pat. No. 5,809,429, which is incorporated herein by reference in its entirety. An embodiment of this improved cable contains one row of slots in the cable's outer conductor which are configured to produce a radiated field polarized perpendicularly to the axis of the cable to avoid the radiation of a field polarized parallel to the cable axis and to provide coupling energy between the interior of the cable and the slots. Another embodiment of this improved cable contains two parallel rows of slots disposed in the outer conductor diametrically opposite each other so that the cable performance would be independent of the wall-mounting position.

In practice, when using the cable with a single row of slots, attention must be given to the slot position during the mounting of this cable on a wall. Preferably, for best performance, all the slots should be facing outward away from the wall. A cable mounted with all of the slots facing outward away from the wall performs superior (see FIG. 1*a*) to a cable which has slots over a substantial length of cable facing inward towards the wall (see FIG. 1*b*). FIG. 1*c* illustrates a cable 10 containing a row of axially aligned slots 11 according to one embodiment of the cable disclosed in commonly-owned U.S. Pat. No. 5,809,429, incorporated by reference above.

Cable machines used in industry today tend to twist the cable as the cable is formed during manufacturing and/or reeled for shipping. The effect of the cable twist is the random rotation of slots over unpredictable lengths of cable. It has been observed that during cable manufacturing the slots of the cable can be rotated 360° over 180 feet of the cable. For example, this rotation can occur abruptly for a substantial length of cable so that the slots switch from being rotated 0° in the circumferential direction to being rotated 180° over a length of cable, and then again being rotated another 180° back to the first position for the next length of cable, where the rotations between 0° and 180° are random.

Another problem associated with the manufacture of radiating coaxial cable having all slots aligned in a row along the axis of the cable is mechanical slot compression. Such a cable is manufactured by wrapping the outer conductor, already having the slots formed therein, around the cable. During wrapping, the slots are compressed in the circumferential direction with respect to the cable causing the slots to become narrower. This mechanical slot compression results in less slot area through which the cable can emit or receive a signal. To remedy mechanical slot compression, tape is often affixed to the outer conductor before wrapping. The tape reinforces the outer conductor to help maintain the shape of the slots during wrapping. However, taping does not prevent slot compression; rather, it lessens its effect. Further, taping increases manufacturing time and expense.

FIGS. 1*a* and 1*b* provide an example which illustrates the effect that facing slots towards the wall has on the received signal level. A 180 foot length of cable that experienced the aforementioned twisting during manufacturing and reeling contained a 90 foot mid-portion having slots rotated so as to face inward towards the wall. The remaining portion of the cable was situated so that the slots faced outward away form the wall. This degree of slot rotation is not uncommon for a cable that has experienced twisting during manufacturing and reeling. The coupling amplitude of a 900 MHz signal was measured along the length of this cable. The type of signal obtained is shown in FIG. 1*b* and is undesirable because the drop in signal strength can result in degraded information received over such a long interval or a complete loss of communication over the interval. The magnitude of this null can be appreciated by comparing FIG. 1*b* with FIG. 1*a*. Thus, there is a need to remedy this effect in order to use a radiating cable in a radio communication system that is to provide a steady signal. Furthermore, there is a need for a radiating cable whose performance is independent of the wall mounting position of the cable.

SUMMARY OF THE INVENTION

An object of some embodiments of the present invention is to provide an improved radiating coaxial cable which can be mounted close to, or even on, a wall (even a metallic wall) or other surface independent of the cable orientation without significantly degrading the operation of the radio communication system in which the radiating cable is used.

Another object of some embodiments of the present invention is to provide an improved radiating coaxial cable which can be manufactured without experiencing mechanical slot compression.

In accordance with one embodiment of the present invention, the foregoing objectives are realized by providing a radiating coaxial cable having a longitudinal axis comprising an inner conductor having a longitudinal axis wherein the axis of the inner conductor defines the axis of the cable. The cable also comprises a dielectric material surrounding the inner conductor. A continuous outer conductor surrounds the dielectric and is in direct contact therewith and is spaced from the inner conductor. The outer conductor has a plurality of slots disposed therein with adjacent slots being spaced in the axial direction. According to some embodiments of the present invention, the slots are helically disposed in the circumferential direction.

According to some embodiments of the present invention, the radiating coaxial cable having helically disposed slots in the cable's outer conductor can be mounted without regard to the direction which the slots are facing in relation to the signal transmitter or receiver.

Also according to some embodiments of the present invention, an improved radio communication system is provided which includes the above radiating cable located within or adjacent to a prescribed area containing a multiplicity of radio transmitters, receivers or transceivers ("radio units"), which may be either mobile or fixed. Signals are transmitted to and received from the various radio units via the radiating cable.

DETAILED DESCRIPTION OF THE PREFERRED EMBODIMENTS

Figure 1A:
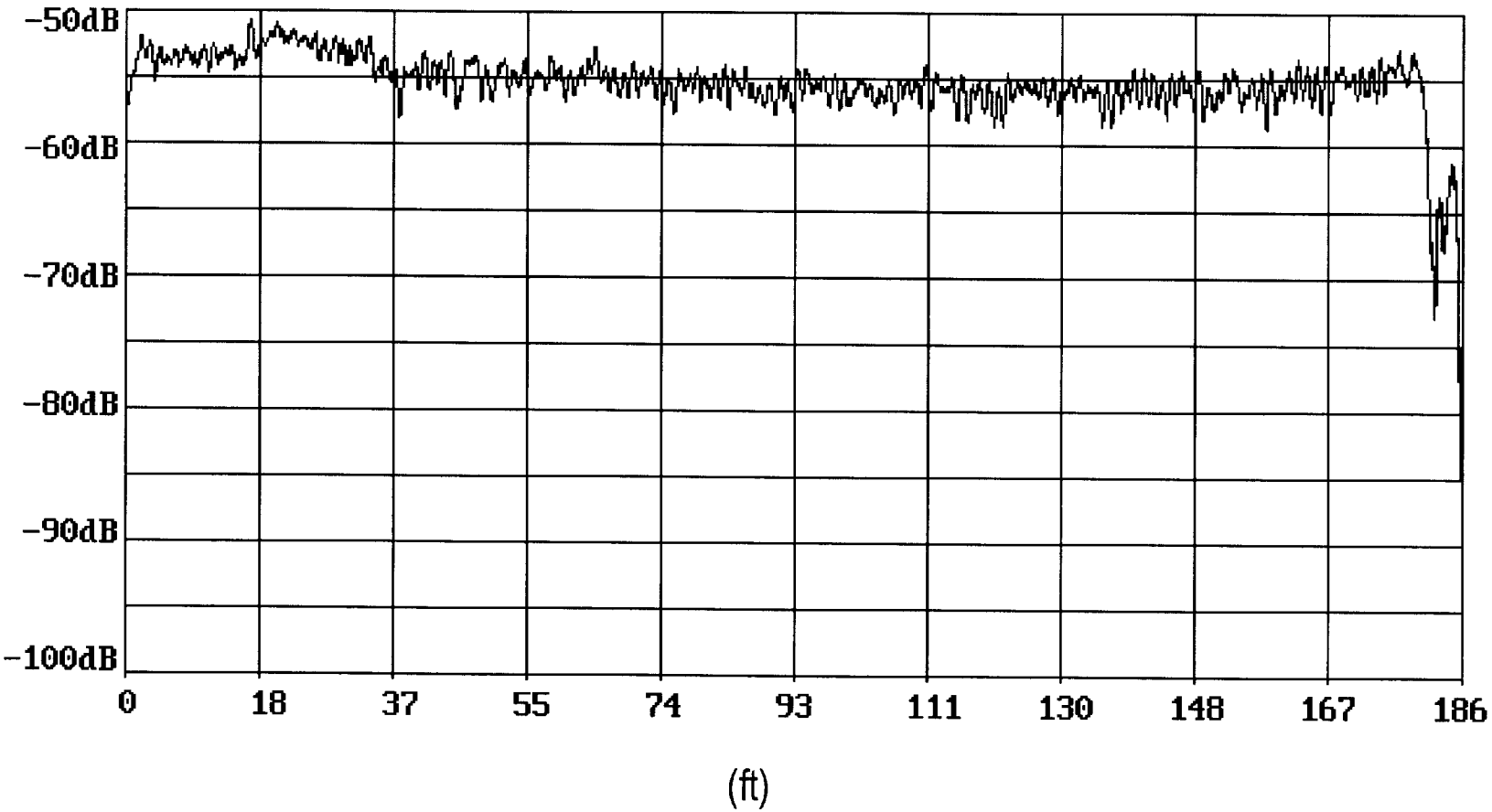
FIG. 1*a* is a plot of the indoor measurements of the continuous wave signal level (in dB) taken along a 180 foot length of a radiating coaxial cable having linearly aligned slots facing outward, measured at a perpendicular distance of six feet away from the coaxial cable and at the same height as the coaxial cable, while operating at a fixed frequency of 900 MHz.

While the invention is susceptible to various modifications and alternative forms, specific embodiments thereof have been shown by way of example in the drawings and will be described in detail herein. It should be understood, however, that it is not intended to limit the invention to the particular forms disclosed, but, to the contrary, the intention is to cover all modifications, equivalents and alternatives falling within the spirit and scope of the invention as defined by the appended claims.

Figures 2A, 2B:
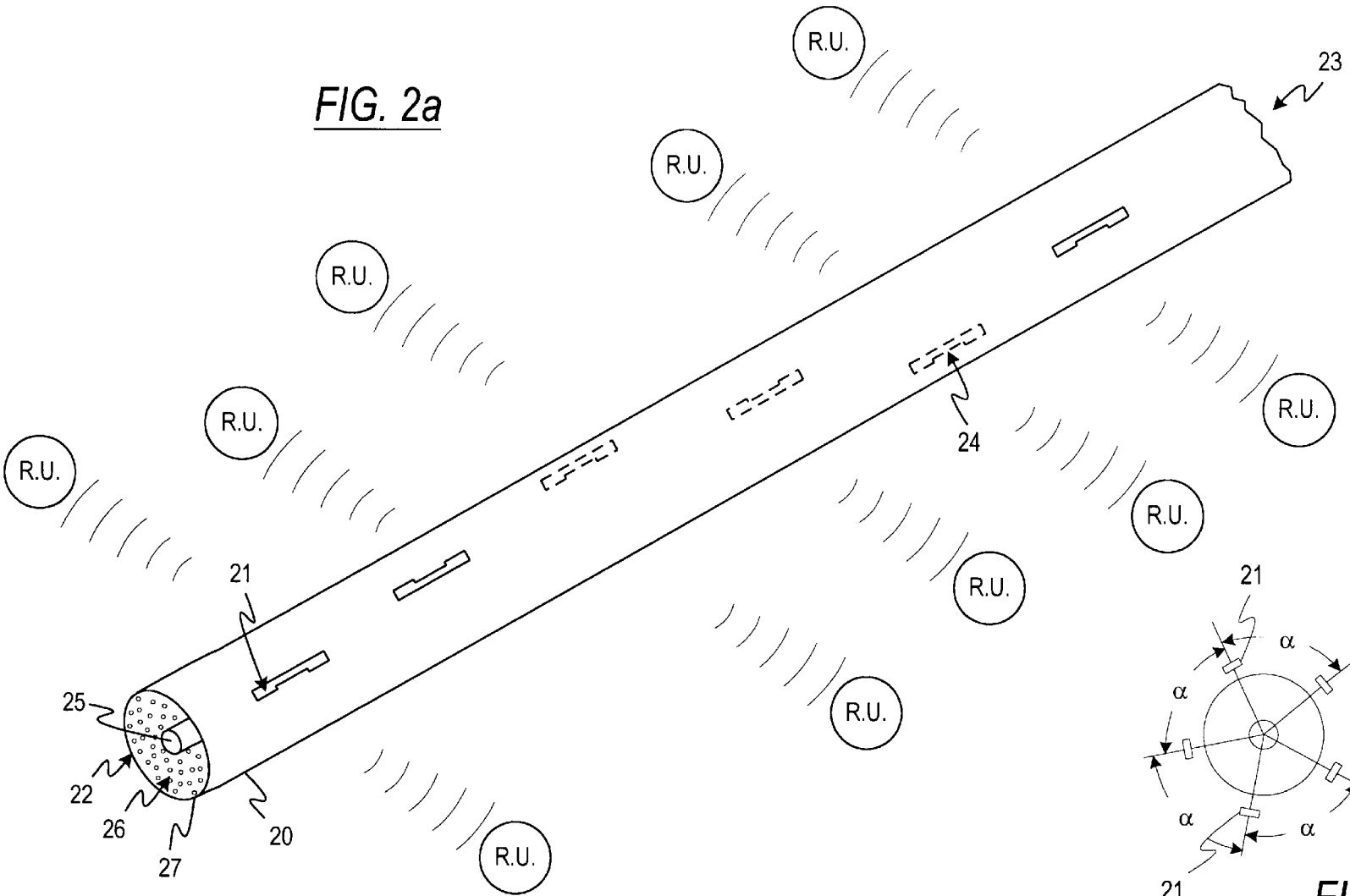
FIG. 2*a* is a perspective view of a radiating coaxial cable having slots helically disposed at 72° according to one embodiment of the present invention, and associated radio units ("R.U.")
FIG. 2*b* is a cross-sectional view of a radiating coaxial cable having slots helically disposed at an angle $\alpha$ according to one embodiment of the present invention.

One embodiment of the radiating coaxial cable 20 according to the present invention is illustrated in FIG. 2*a*. The radiating cable 20 may be used in a wide variety of different applications where multiple radio units, often mobile units, must communicate with one or more base stations within a defined area. One example of such a system is a highway or railroad communication system in which the radiating cable extends along an open highway or railroad (or, also, in a tunnel) for constant communication with mobile radio units in the various vehicles on the open highway or railroad (or in the tunnel). Another example is a wireless local area network (WLAN) of personal computers, printers, servers and the like, located in a common building or on a common floor. This invention is particularly useful in applications where the communication area is sufficiently large that the radiating cable 20 must be at least 60 feet in length.

Figure 4:
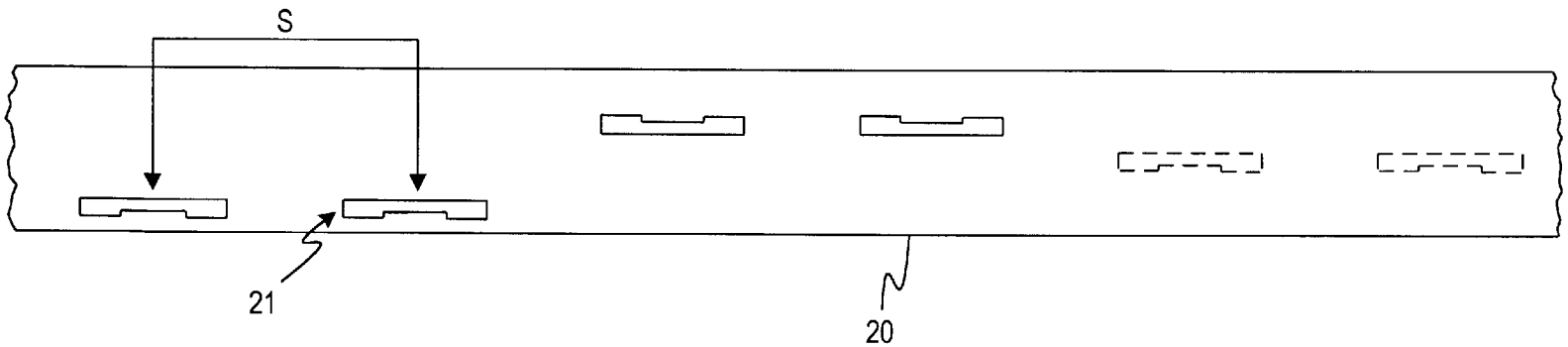
FIG. 4 is a perspective view of a radiating coaxial cable having two slots per cell according to an alternative embodiment of the present invention.

Referring now to FIGS. 2*a,* 2*b,* and 3, a length of a radiating coaxial cable 20 having a series off-resonant slots 21 formed in the cable is shown. The slots 21 are helically disposed in the circumferential direction so adjacent slots 21 are angularly disposed at an angle α from each other. In the illustrated embodiments, the slots 21 are angularly disposed approximately 72° from each other so that the circumferential position of the slots 21 repeats every sixth slot. In an alternative embodiment of the present invention cells of slots are helically disposed in the circumferential direction along the length of the cable 20. In the embodiment illustrated in FIG. 4, each cell comprises two slots axially aligned in the same angular position along the cable. In other alternative embodiments, the cells of slots may comprise more than two slots.

Referring again to FIGS. 2*a,* 2*b,* and 3, the cable 20 is a typical coaxial cable having an inner conductor 25 insulated from an outer conductor 27 by a dielectric material 26. The inner conductor 25 defines the longitudinal axis of the cable. The slots 21 are spaced by a center-to-center distance, S, from each other in the axial direction. When a signal is fed into one end 22 of the cable 20 and propagated through the cable 20 to a matched load at the opposite end 23, a portion of the signal is radiated from the slots 21 along the entire length of the cable. The radiated field is polarized perpendicularly to the axis of the cable 20 and can be detected by radio units ("R.U.") anywhere along the length of the cable 20. The cable 20 can also receive radiated signals from the radio units anywhere along the length of the cable 20. These received signals are propagated through the cable to a receiver (not shown) at the end 22 of the cable 20. To cause each slot 21 to radiate energy from the interior of the coaxial cable 20, a coupling device such as tab 24 is provided at each slot 21. The tabs 24 may lie in the cylinder of the outer conductor 27 of the cable 20, or the tabs 24 may be bent into the interior of the cable 20 for increased coupling. The phase of the slot's 21 electric field are reversed for successive slots 21 by forming the tabs 24 on alternating edges of successive slots 21, so that the tabs 24 are on opposite edges of each pair of adjacent slots 21.

The slots 21 are axially spaced from each other by a distance, S. The dimensions of both the slots 21 and the tabs 24 are chosen to avoid any significant radiation attenuation of the signals that are propagated longitudinally through the cable 20, thereby ensuring that the signal is radiated with adequate strength along the entire length of the cable 20. Thus, the radiated energy per unit length of cable, as well as the radiated-attenuation per unit length of the cable, are relatively low.

Figure 3:
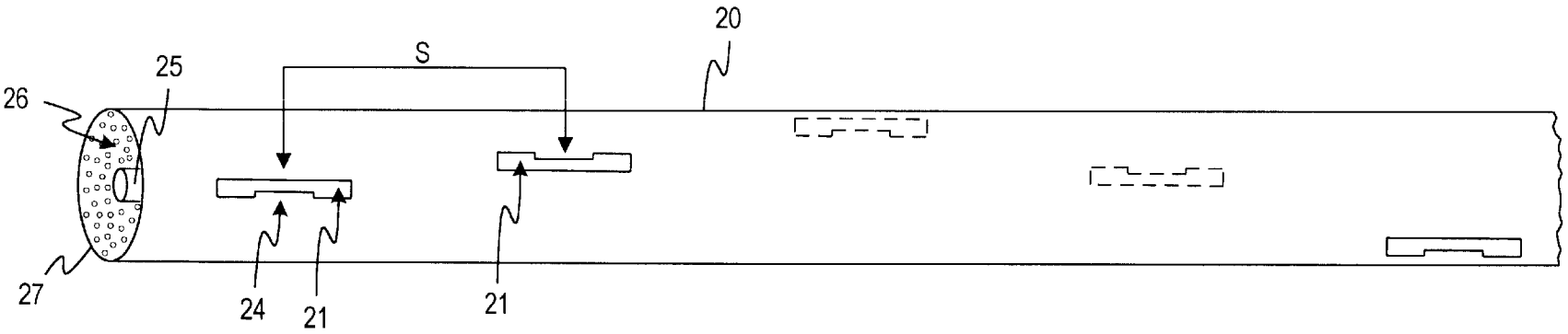
FIG. 3 is another perspective view of a radiating coaxial cable having slots helically disposed at 72° according to one embodiment of the present invention.
Figure 5:
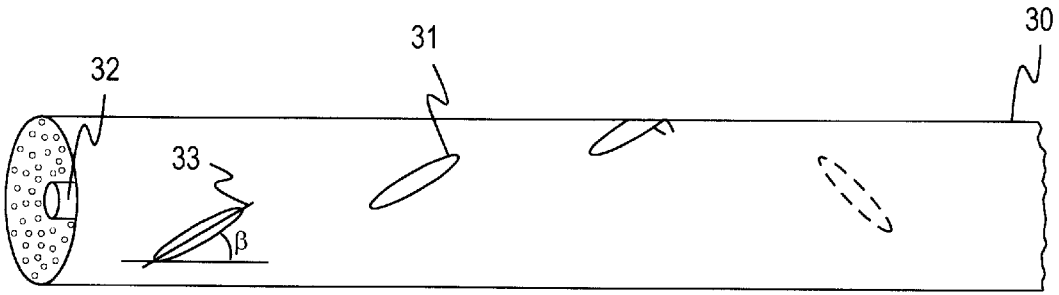
FIG. 5 is a perspective view of a radiating coaxial cable having tilted slots helically disposed according to an alternative embodiment of the present invention.

While FIGS. 2*a* and 3 illustrate slots 21 that are substantially rectangular in shape, the helical disposition of the slots according to an embodiment of the present invention is applicable to a radiating coaxial cable having slots of any shape. For example, FIG. 5 illustrates an alternative embodiment of the present invention wherein a radiating coaxial cable 30 contains slots 31 that are elliptical in shape and have a longitudinal axis 33 which is tilted at an angle β with respect to the axis 32 of the cable 30. In the illustrated embodiment, the longitudinal axis 33 of the slots 31 are tilted at an angle β of approximately30° with respect to the axis 32 of the cable 30. In other alternative embodiments, the slots 31 may be tilted with respect to the axis 32 of the cable 30 at an angle β ranging from approximately 0° to 90°.

Figure 6:
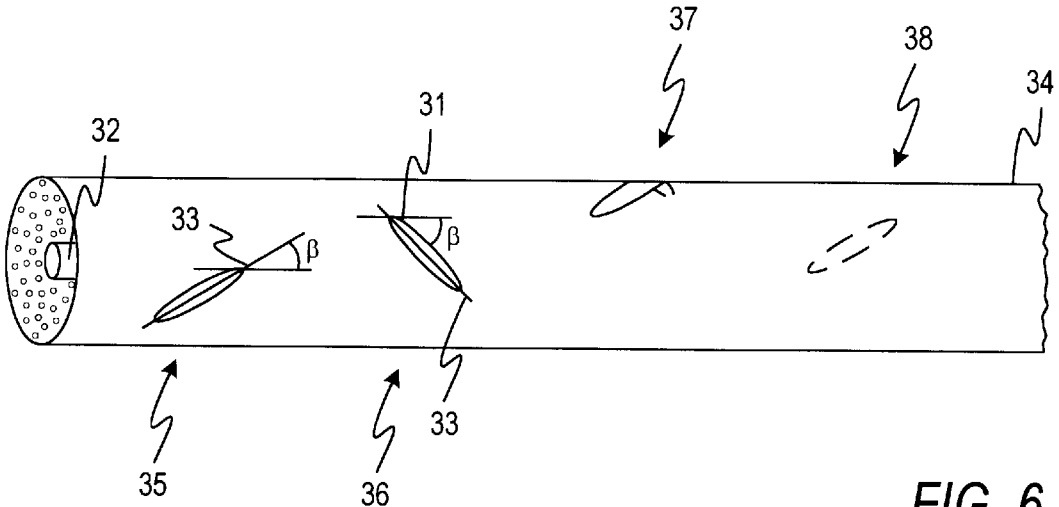
FIG. 6 is a perspective view of a radiating coaxial cable having slots in tilted alternating directions helically disposed according to an alternative embodiment of the present invention.

FIG. 6 illustrates another alternative embodiment of the present invention wherein a radiating coaxial cable 34 contains elliptical-shaped slots 3 1. The longitudinal axis 33 of adjacent slots 31 are tilted in alternating directions with respect to the axis 32 of the cable 34 at an angle at an angle β. Viewing the cable 34 shown in FIG. 6 from left to right, the slot 31 in the first position 35 is tilted at an angle β of approximately positive 30° with respect to the axis 32 of the cable 34. The adjacent slot 31 (in the second position 36) is tilted at an angle β of approximately negative 30° with respect to the axis 32 of the cable 34. The tilting of the slots repeats in a similar manner along the length of the cable: the slot in the third position 37 is tilted at an angle at an angle β of approximately positive 30° with respect to the axis 32 of the cable 34; the slot in the fourth position 38 is tilted at an angle at an angle β of approximately negative 30° angle with respect to the axis 32 of the cable 34; and so on. In alternative embodiments, adjacent slots may be tilted in alternating positive and negative directions with respect to the axis 32 of the cable 34 at an angle at an angle β ranging between approximately negative 90° and positive 90°.

Figure 7:
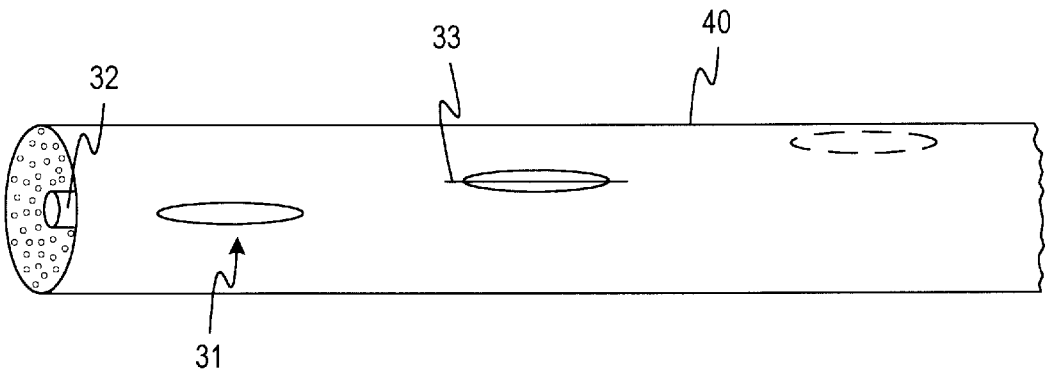
FIG. 7 is a perspective view of a radiating coaxial cable having helically disposed slots in an alternative embodiment of the present invention.

FIG. 7 illustrates a radiating coaxial cable 40 containing elliptical-shaped slots 31 having the longitudinal axis 33 of the slots 31 substantially parallel to the axis 32 of the cable 40 according to another embodiment of the present invention.

Figure 8:
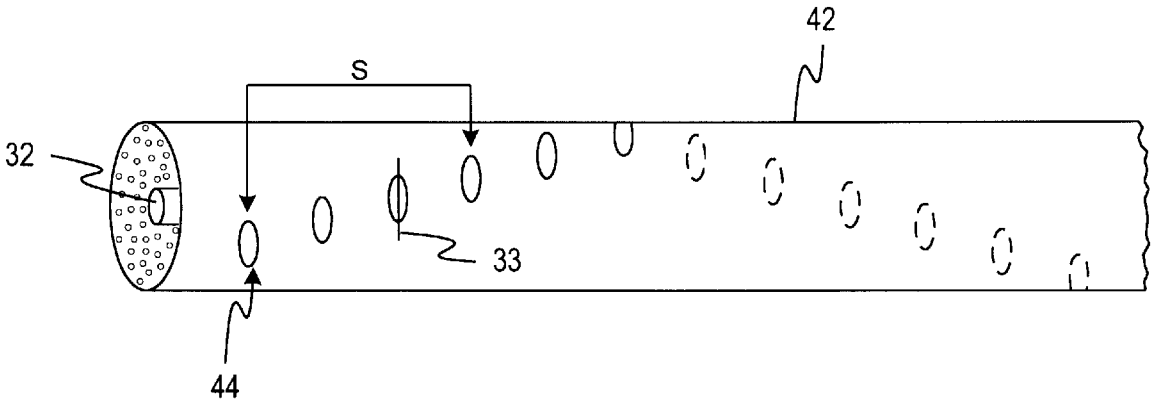
FIG. 8 is a perspective view of a radiating coaxial cable having many slots per wavelength helically disposed according to an alternative embodiment of the present invention.

In other alternative embodiments, the center-to-center axial spacing, S, of adjacent slots is determined by the specified frequency range of the particular application in which the cable is used. Usually, the wavelength of the signal inside the cable varies from application to application. For example, in the embodiment illustrated in FIG. 3, the center-to-center spacing, S, is usually such that only a few slots 11 are provided in each wavelength (of the signal inside the cable) so that S is much larger than one-fourth of the wavelength. In other alternative embodiments, S is very much smaller then one-fourth the wavelength as shown in FIG. 8. FIG. 8 illustrates a radiating coaxial cable 42 according to an alternative embodiment of the present invention which has many slots 44 per wavelength. The slots 44 of cable 42, as shown in FIG. 8, have the longitudinal axis 33 of the slot 44 substantially perpendicular to the axis 32 of the cable 42. In other alternative embodiments of the cable 42, the longitudinal axis 33 of the slots 44 may be tilted with respect to the axis 32 of the cable.

Figure 9:
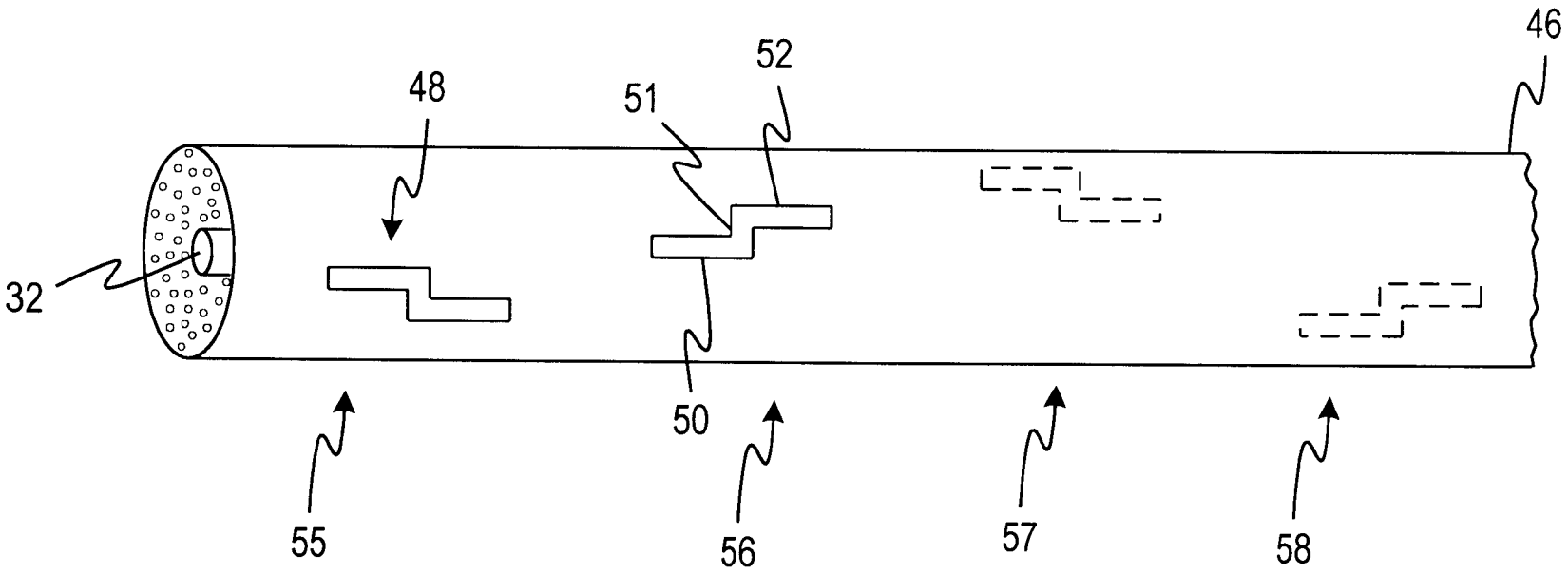
FIG. 9 is a perspective view of a radiating coaxial cable having zigzagged slots helically disposed according to an alternative embodiment of the present invention.

In still another alternative embodiment, a radiating coaxial cable 46 contains zigzagged shaped slots 48 as illustrated in FIG. 9. The zigzagged shaped slots 48 have three sections: a first section 50; a second section 51; and a third section 52. The first and third sections 50, 52 are disposed substantially parallel to the axis 32 of the cable 46 and are connected via the second section 51 which is disposed substantially perpendicular to the axis of the cable 46. In the embodiment illustrated in FIG. 9, adjacent slots are flipped so that adjacent slots face alternating directions. Viewing FIG. 9 from left to right, the slot 48 in the second position 56 is the mirror image of the slot 48 in the first position 55. The slots 48 are flipped in this manner along the length of the cable. The slot 48 in the fourth position 58 is the mirror image of the slot 48 in the third position 57, and so on.

Slot compression is often a problem with cables having a row of axially aligned slots because of the limited amount outer conductor surface area between adjacent slots. A cable having helically disposed slots according to the present invention mitigates against the aforementioned problems associated with mechanical slot compression. The cable having helically disposed slots provides increased area between adjacent slots resulting in an increased ability to maintain the slot edge position and avoids slot compression during the wrapping of the outer conductor on to the cable. Hence, the outer conductor having helically disposed slots does not need to be tapped before wrapping. Therefore, a cable having helically disposed slots according to one embodiment of the present invention can be manufactured without devoting time and money to guard against slot compression.

In alternative embodiments, a cable 20 having helically disposed slots 21 can have slots 21 disposed from each other at angles, ranging approximately from 36° to 120°. In the case of slots 21 disposed from each other at 120°, the circumferential slot position repeats every third slot 21. In the case of slots 21 disposed from each other at 36°. the circumferential or angular slot position repeats every tenth slot 21. However, it has been found that decreasing the angular distance between slots 11 beyond this range may be undesirable because positioning the adjacent slots 11 closer to each other by decreasing the angular position between the slots 11 decreases the outer conductor surface area between the slots 11 which can lead to mechanical slot compression. As a slot is compressed the effective signal radiation from that slot is reduced. Severe slot compression or slot compression along a significant length of cable 10 can greatly effect the performance of the cable 10. According to some embodiments, adjacent slots are disposed at either 60° or 90° from one another. Disposing adjacent slots at angles of 60° and 90° causes the slots to repeat their angular position every sixth slot or fourth slot, respectively. Having slots repeat their angular position on an even number of slots reduces the cable manufacturing costs associated with tooling.

Figure 1B:
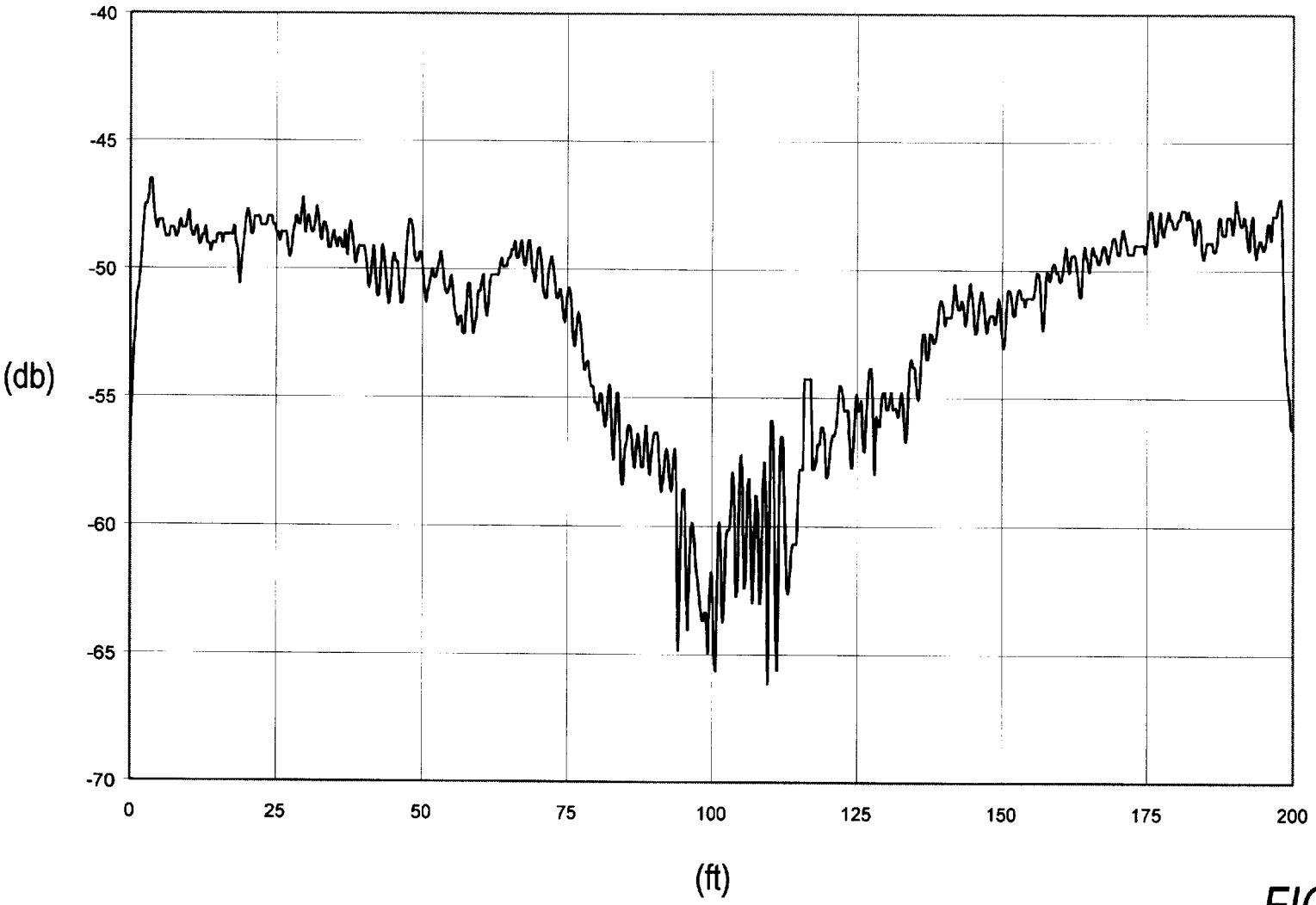
FIG. 1*b* is a plot of the indoor measurements of the continuous wave signal level (in dB) taken along a 180 foot length of a radiating coaxial cable having slots experiencing a 360° rotation over 180 feet, measured at a perpendicular distance of six feet away from the coaxial cable and at the same height as the coaxial cable, while operating at a fixed frequency of 900 MHz.
Figure 1C:
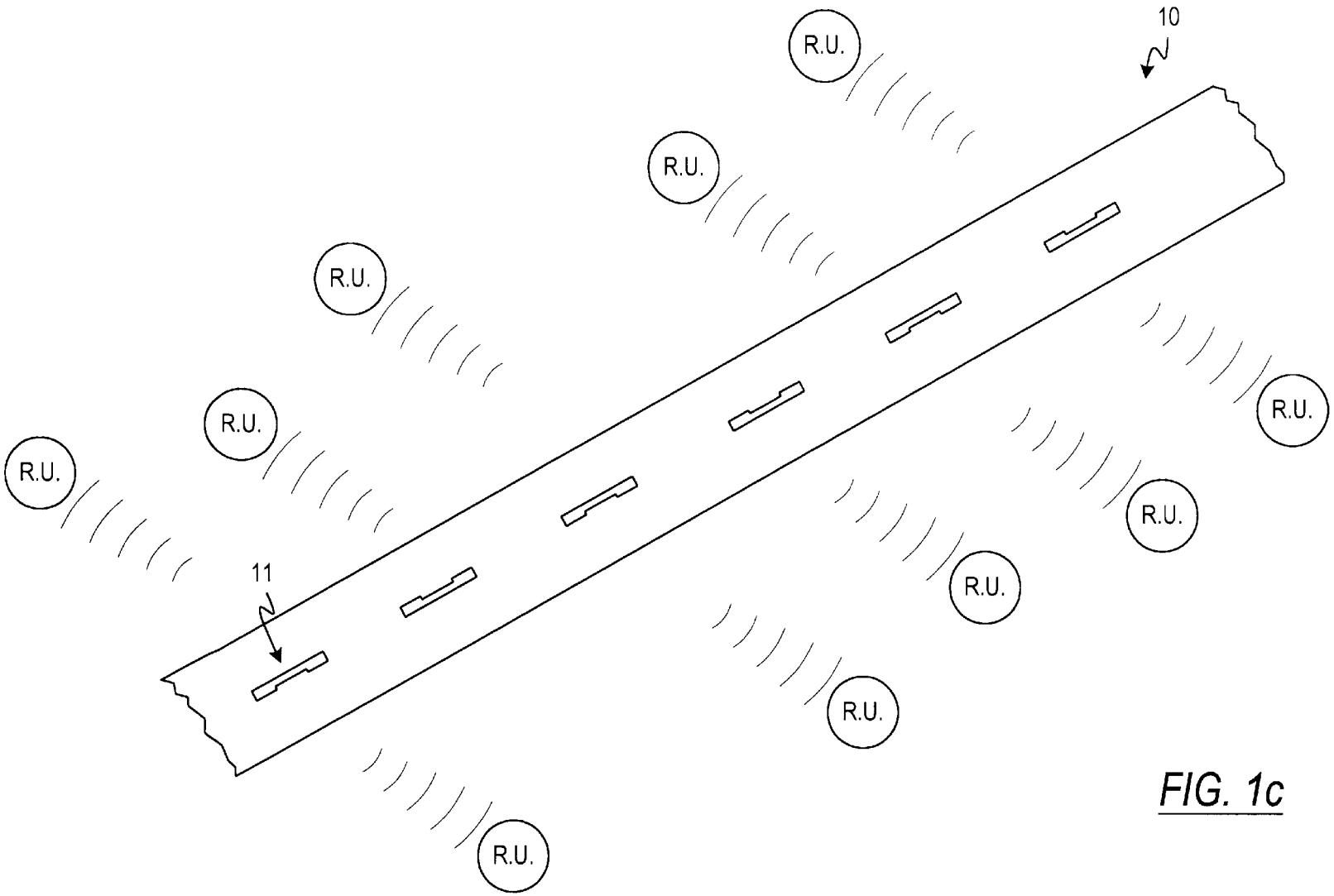
FIG. 1*c* is a perspective view of a cable with a linear arrangement of slots according to an embodiment of the cable disclosed in commonly-owned U.S. Pat. No. 5,808,429.
Figure 1D:
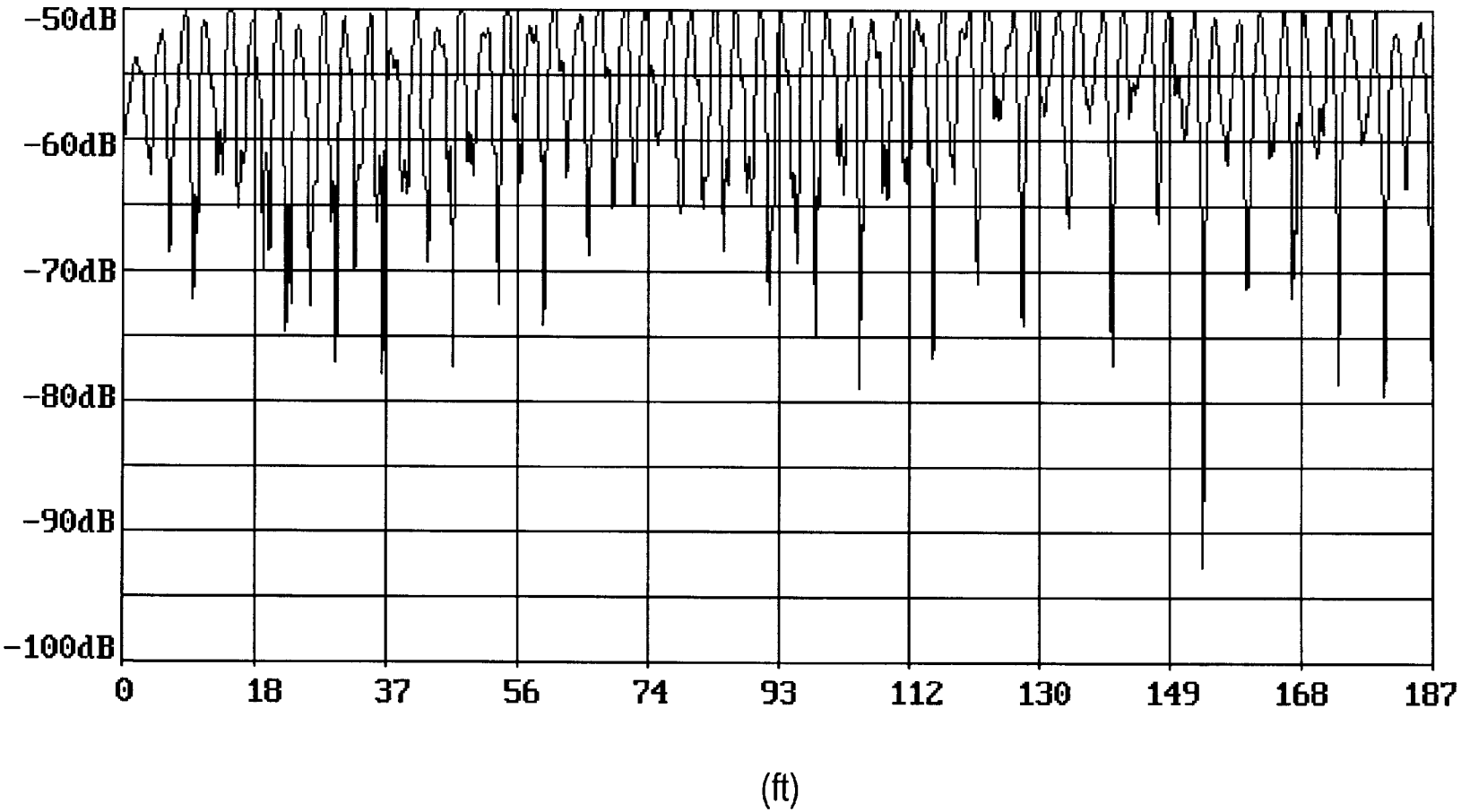
FIG. 1*d* is a plot of the indoor measurements of the continuous wave signal level (in dB) taken along a 180 foot length of a radiating coaxial cable having helically disposed slots, wherein adjacent slots are angularly disposed at 72° from each other, according to one embodiment of the present invention, measured at a perpendicular distance of six feet away from the coaxial cable and at the same height as the coaxial cable, while operating at a fixed frequency of 900 MHz.
Figure 1E:
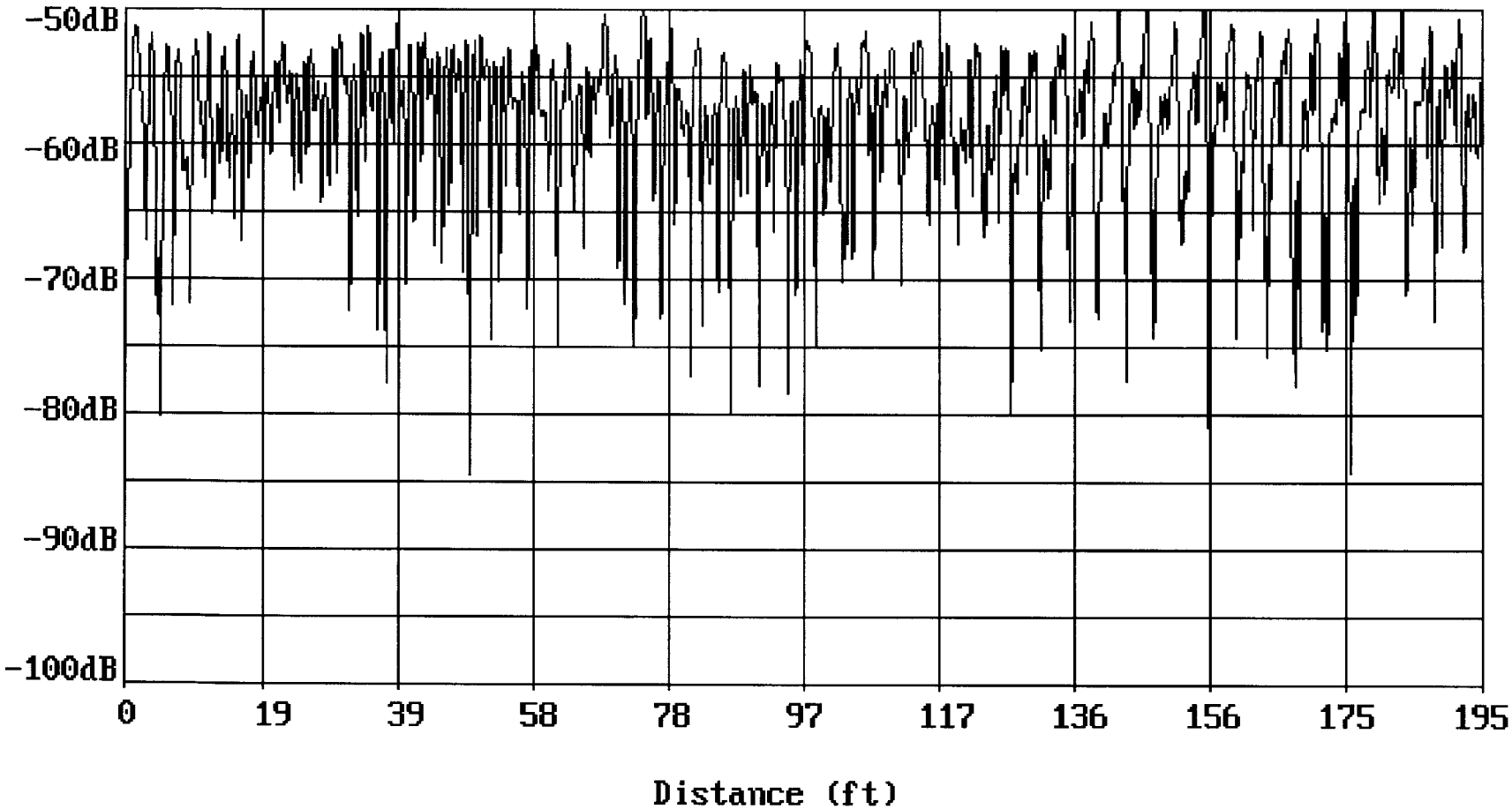
FIG. 1*e* is a plot of the indoor measurements of the continuous wave signal level (in dB) taken along a 180 foot length of a radiating coaxial cable having helically disposed slots, wherein adjacent slots are angularly disposed at 120° from each other, according to one embodiment of the present invention, measured at a perpendicular distance of six feet away from the coaxial cable and at the same height as the coaxial cable, while operating at a fixed frequency of 900 MHz.

Referring now to FIG. 1*d,* the signal radiating performance of a radiating coaxial cable such as shown in FIG. 3 with helically disposed slots at 72° according to one embodiment of the present invention is shown. FIG. 1*d* is a plot of the strength of a fixed frequency signal radiated from the cable over the length of the cable. The cable used in connection with FIG. 1*d* as well as the cables used in connection with FIGS. 1*a* and 1*b* have the same diameter, center-to-center slot spacing, S, and slot configuration. The slot dimensions and configuration were chosen to have the cable operate optimally from approximately 380–1140 MHz. The cable was 180 feet in length and was operated at a frequency of 900 MHz. The perpendicular distance between the cable axis and the measured field point was six feet, while the cable and measured field point were at the same height. FIG. 1*e* illustrates that similar results were obtained for a cable identical to that described but having slots helically disposed at 120° according to an alternative embodiment of the present invention.

Comparison of FIGS. 1*a,* 1*b,* and 1*d* indicate that the ideal case, a cable having all slots facing outward (FIG. 1*a* ), produces the strongest and steadiest signal. However, greater time and effort must be expended to mount a cable to a wall in the ideal manner and in some cases it may not be possible. A cable having experienced slot rotation due to cable twisting occurring during both manufacturing and/or reeling (FIG. 1*b* ) produces the most undesirable signal due to the aforementioned deep null, occurring over the 90 foot portion of the cable (from the approximately 75 feet to 165 feet point on the cable) wherein the slots are rotated towards the wall, which can result in communication loss or information degradation. While FIG. 1*d* illustrates a decrease in signal level from the ideal case (FIG. 1*a* ), the cable with helically disposed slots still radiates a steady peak signal which is relatively flat but contains some sharp dips. However, these dips are not significant because they occur over only a few inches. If the receiver is on a moving vehicle, it will only experience a signal drop for a very short time. Likewise, a fixed receiver or its antenna only has to be moved a few inches to receive a strong signal. Therefore, the cable having helically disposed slots, according to an embodiment of the present invention, can be installed without regard to cable orientation and yet radiate nearly as well as the ideal case.

Because a radiating cable having helically disposed slots radiates a substantially flat near-field pattern, it provides reliable (non-fading) communications to and from radio units distributed along the length of the cable. This reliability is particularly useful in digital communications because it permits the attainment of low bit error rates ("BERs"). For example, digital data communications may require BERs as low as $10^{-8}$ to avoid loss of significant data. These low BERs are attainable with a substantially flat near-field pattern because the fluctuations, or oscillations, in the pattern arc of such a small amplitude that losses of one or more bits of data are very small. The substantially flat near-field patterns of the present invention are also desirable for analog communication signals, to avoid spurious distortions in the analog signals.

Figure 10A:
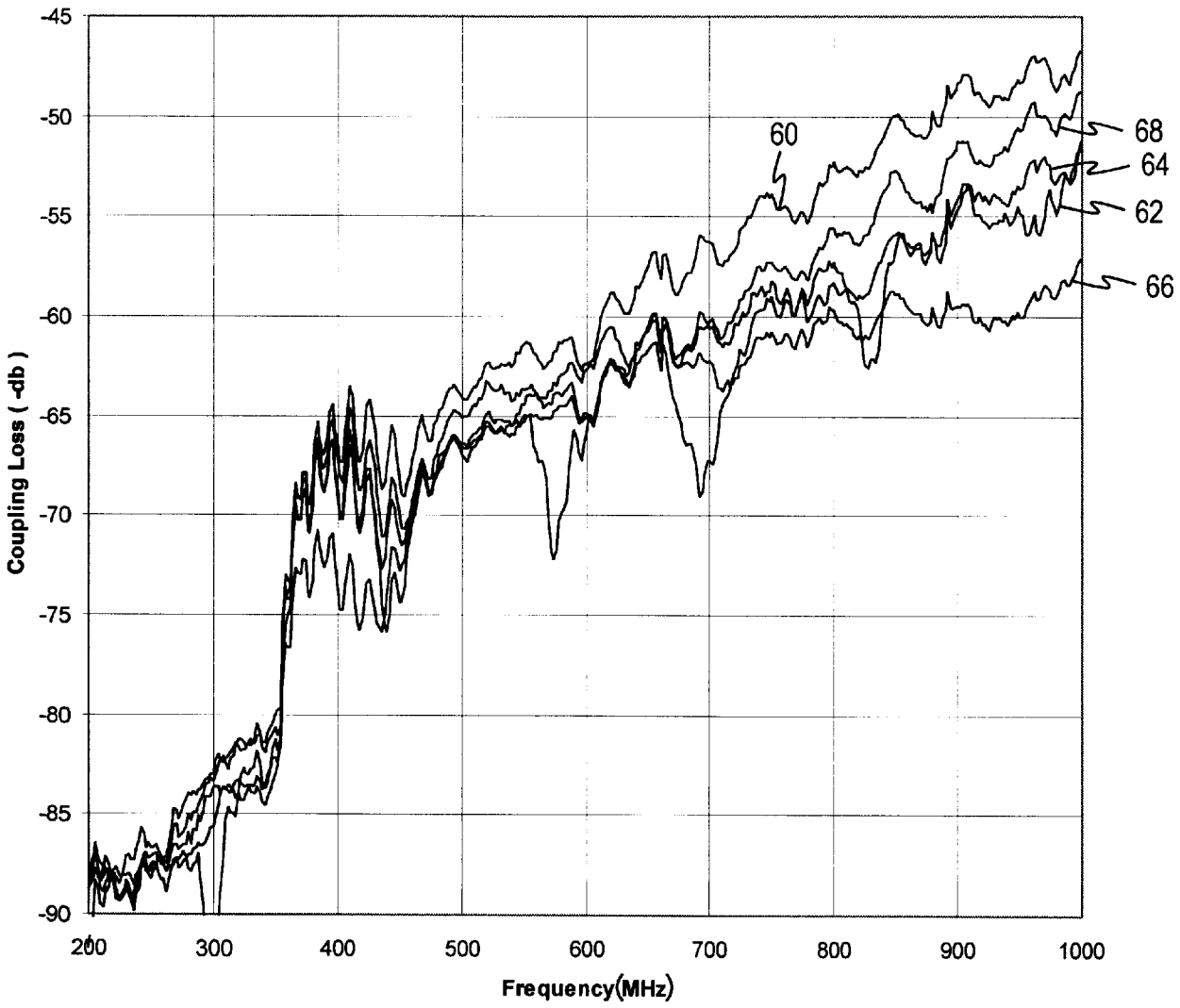
FIG. 10*a* is an indoor measurement of the coupling loss (in dB) taken over a frequency range of 200 to 1000 MHz for a radiating coaxial cable such as shown in FIG. 1*c* having lineally aligned slots, wherein each plot represents a 90° rotation of the cable.
Figure 10B:
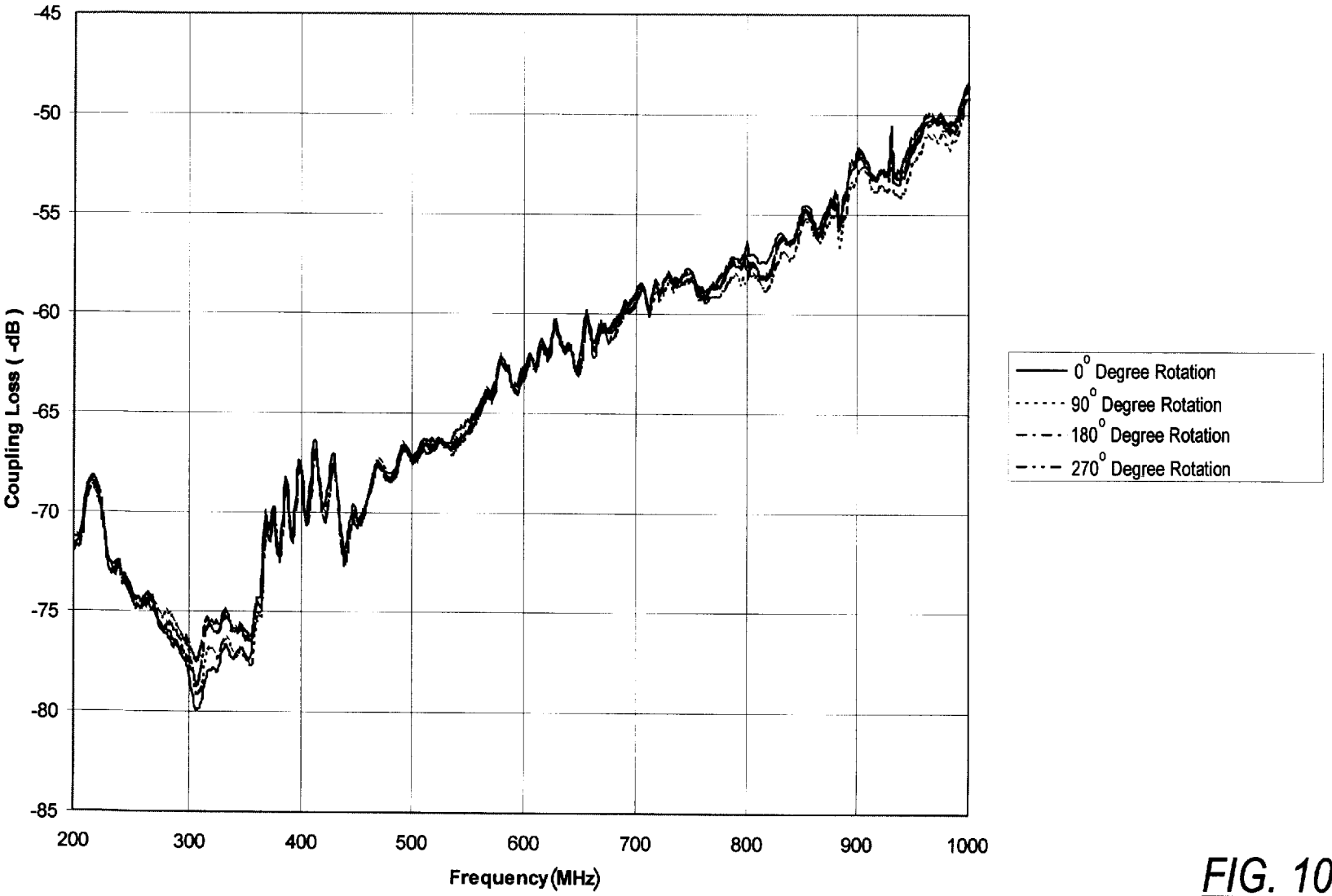
FIG. 10*b* is an indoor measurement of the coupling loss (in dB) taken over a frequency range of 200 to 1000 MHz for a radiating coaxial cable such as shown in FIG. 3 having slots helically disposed at 72°, wherein each plot represents a 90° rotation of the cable.

Referring now to FIGS. 10*a* and 10*b* the signal receiving performance of the radiating cable 20 having helically disposed slots 21 at 72° according to one embodiment of the present invention may be compared to a cable having axially aligned slots. FIG. 10*a* shows the swept frequency measurements for the cases of a cable such as shown in FIG. 1*c* having all slots being disposed along a straight line along the axis but rotated in different angular positions. The frequency of the signal received by the cable is swept from 50 to 1000 MHz in 1/20 of a second and is transmitted by an antenna on a cart moving parallel to the cable at a rate of four inches per second. The distance covered in one frequency sweep is 1/5 inch per sweep. This distance is so small compared to the wavelength, which is at least 11.8 inches at 1000 MHz, that the distance is practically zero inches per sweep; therefore, the sweep is virtually instantaneous. The curve identified by reference number 60 refers to the case where the cable is rotated 0° so that all slots face outward away from the wall. Reference number 62 refers to the case where the cable is rotated upward 90° so that slots are facing the ceiling. Reference number 64 refers to the case where the cable is rotated downward 90° so that the slots face the floor.

Reference number 66 refers to the case where cable is rotated 180 ° so that the slots face inward towards the wall. Finally, reference number 68 refers to the case of a cable having experienced slot rotation due to cable twisting wherein the slots are rotated 360° over a 180 foot cable. FIG. 10*a* illustrates that large drops, up to 12 dB, occur in the signal strength between rotated positions of the cable having all slots linearly aligned. A drop of this magnitude would result in a severely reduced signal causing degradation of information or a complete loss of communication. This result indicates that is it undesirable to use a cable having slots facing towards the wall for more than a minimal portion of the length of the cable.

Figure 11A:
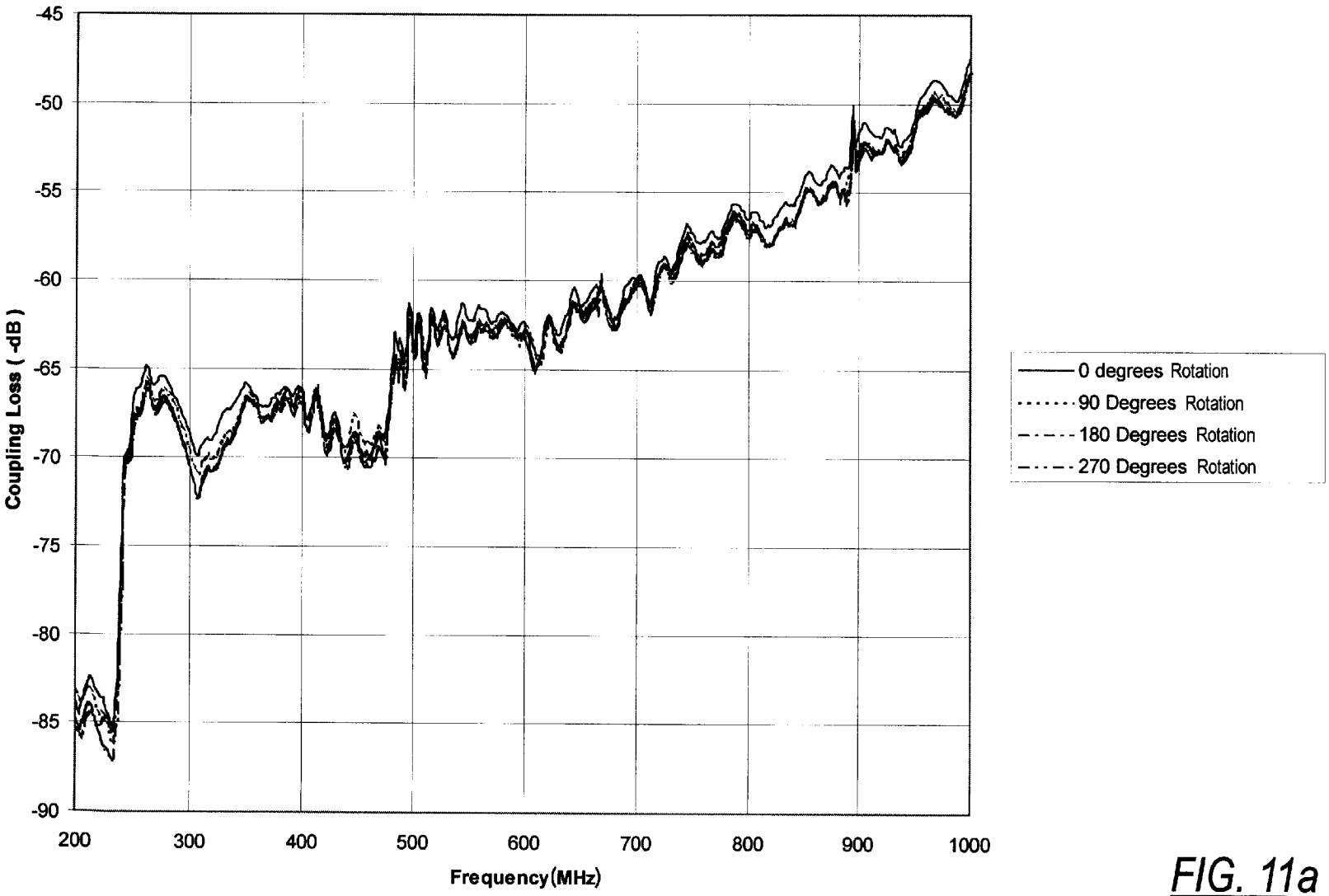
FIG. 11*a* is an indoor measurement of the coupling loss (in dB) taken over a frequency range of 200 to 1000 MHz for a radiating coaxial cable such as shown in FIG. 3 but having slots helically disposed at 120°, wherein each plot represents a 90° rotation of the cable.

FIG. 10*b* illustrates the coupling loss experienced by a cable such as shown in FIG. 3 having slots helically disposed from each other 72° in the circumferential direction according to one embodiment the present invention for the same swept frequencies. The cable having helically disposed slots used in connection with FIG. 10*b* contains the same type of slots and the same axial slot spacing as the cables used in connection with FIG. 10*a*. All of the lines representing measurements for each rotation of the cable of FIG. 10*b* practically fall on top of one another evincing that for any given frequency the signal level is independent of cable rotation. Similar results were obtained from a cable having slots helically disposed 120° from each other according to an alternative embodiment of the present invention (see FIG. 11*a*). Therefore, a cable of the present invention can be mounted without regard to cable position because the slots are distributed about the circumference of the cable; cable twisting does not disturb that distribution. Thus, signal degradation due to the inherent slot rotation occurring during manufacturing and/or cable reeling is reduced or eliminated with a cable having helically disposed slots according to the present invention.

Figure 10C:
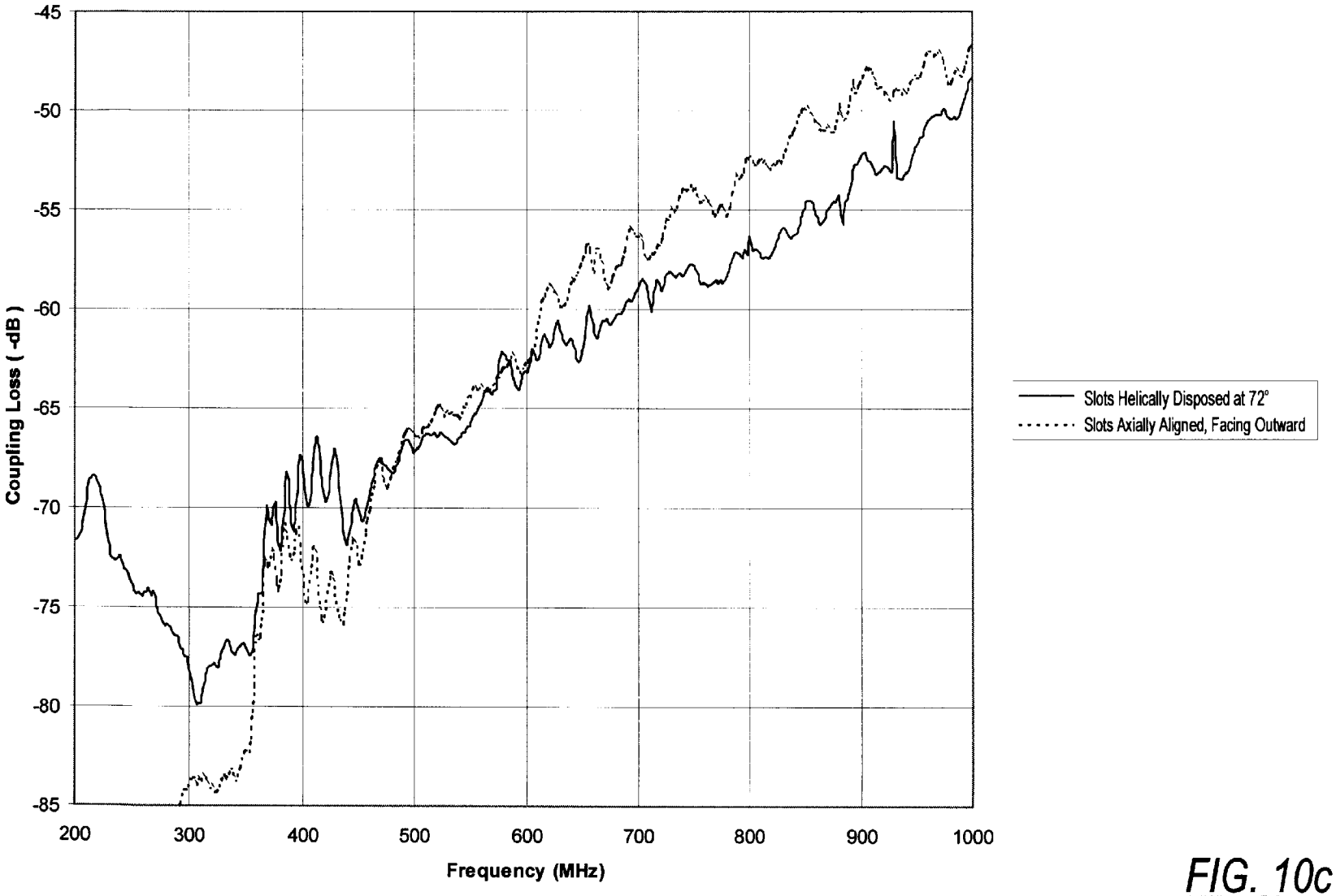
FIG. 10*c* is a comparison of the indoor measurement of the coupling loss (in dB) taken over a frequency range of 200 to 1000 MHz for a radiating coaxial cable such as shown in FIG. 3 having slots helically disposed at 72° and a cable such as shown in FIG. 1*c* having axially aligned slots facing away from the wall.
Figure 10D:
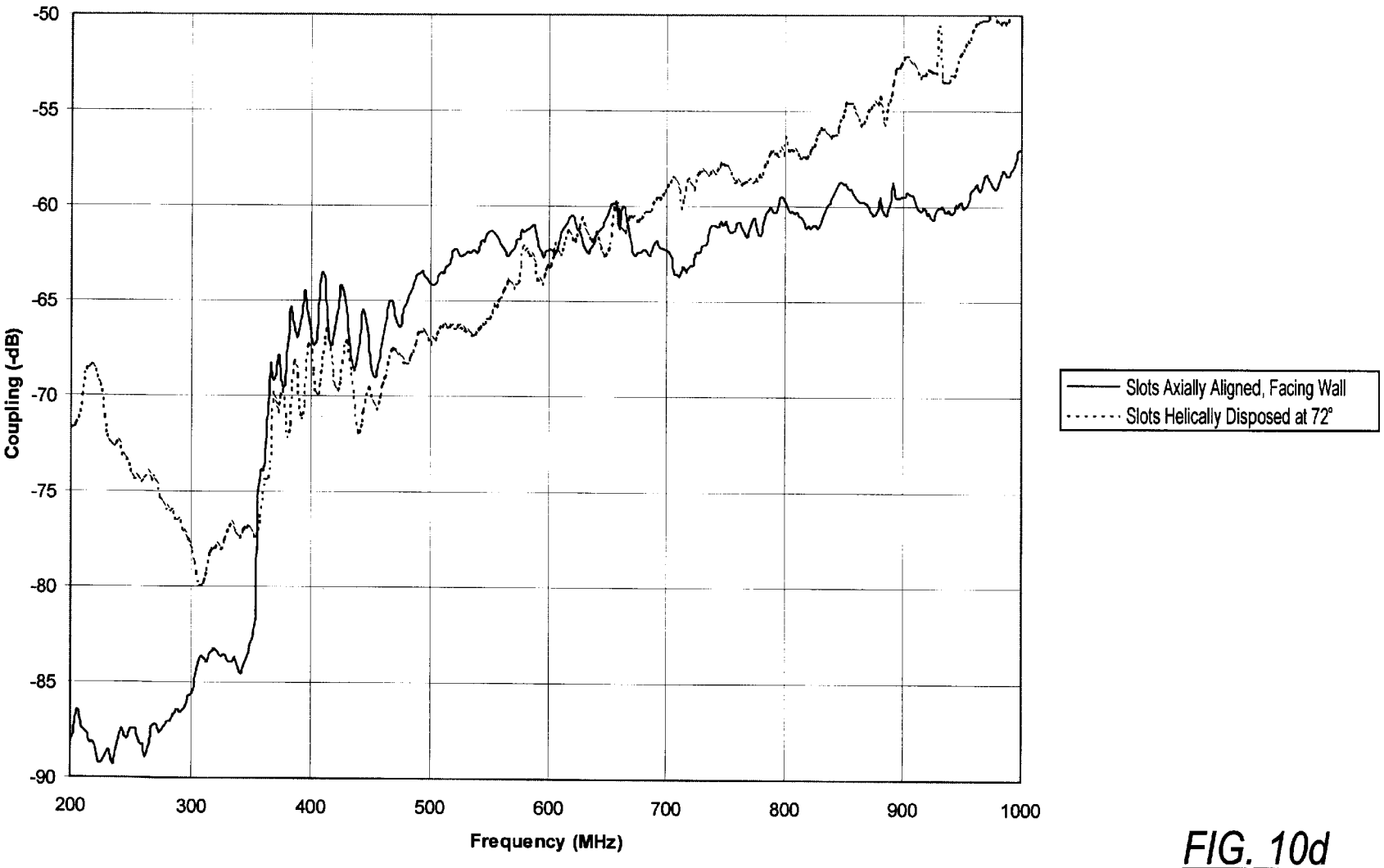
FIG. 10*d* is a comparison of the indoor measurements of the coupling loss (in dB) taken over a frequency range of 200 to 1000 MHz for a radiating coaxial cable such as shown in FIG. 3 having slots helically disposed at 72° and a cable such as shown in FIG. 1*c* having axially aligned slots facing inward towards the wall.
Figure 11B:
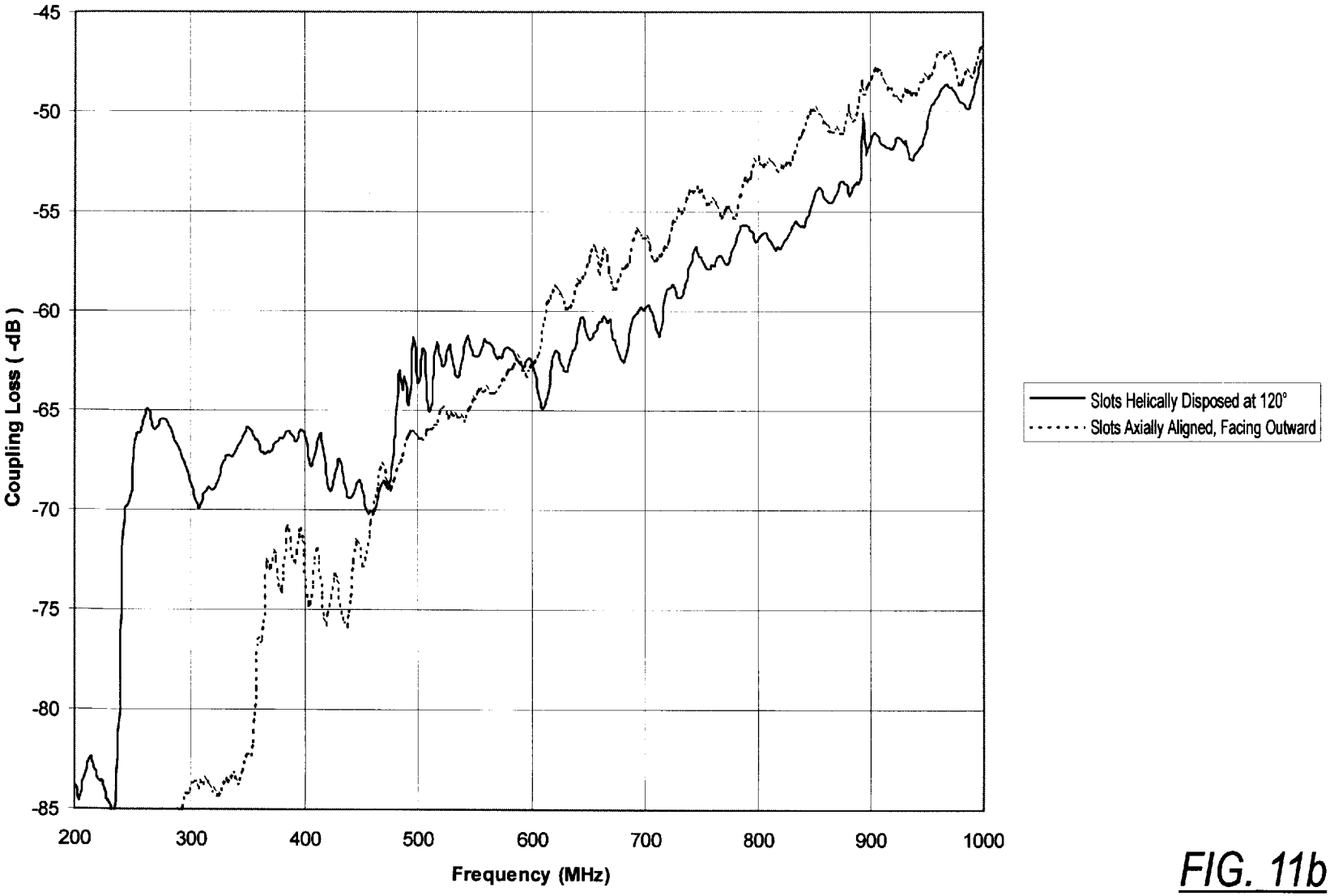
FIG. 11*b* is a comparison of the indoor measurements of the coupling loss (in dB) taken over a frequency range of 200 to 1000 MHz for a radiating coaxial cable such as shown in FIG. 3 but having slots helically disposed at 120° and a cable such as shown in FIG. 1*c* having axially aligned slots facing outward away from the wall.
Figure 11C:
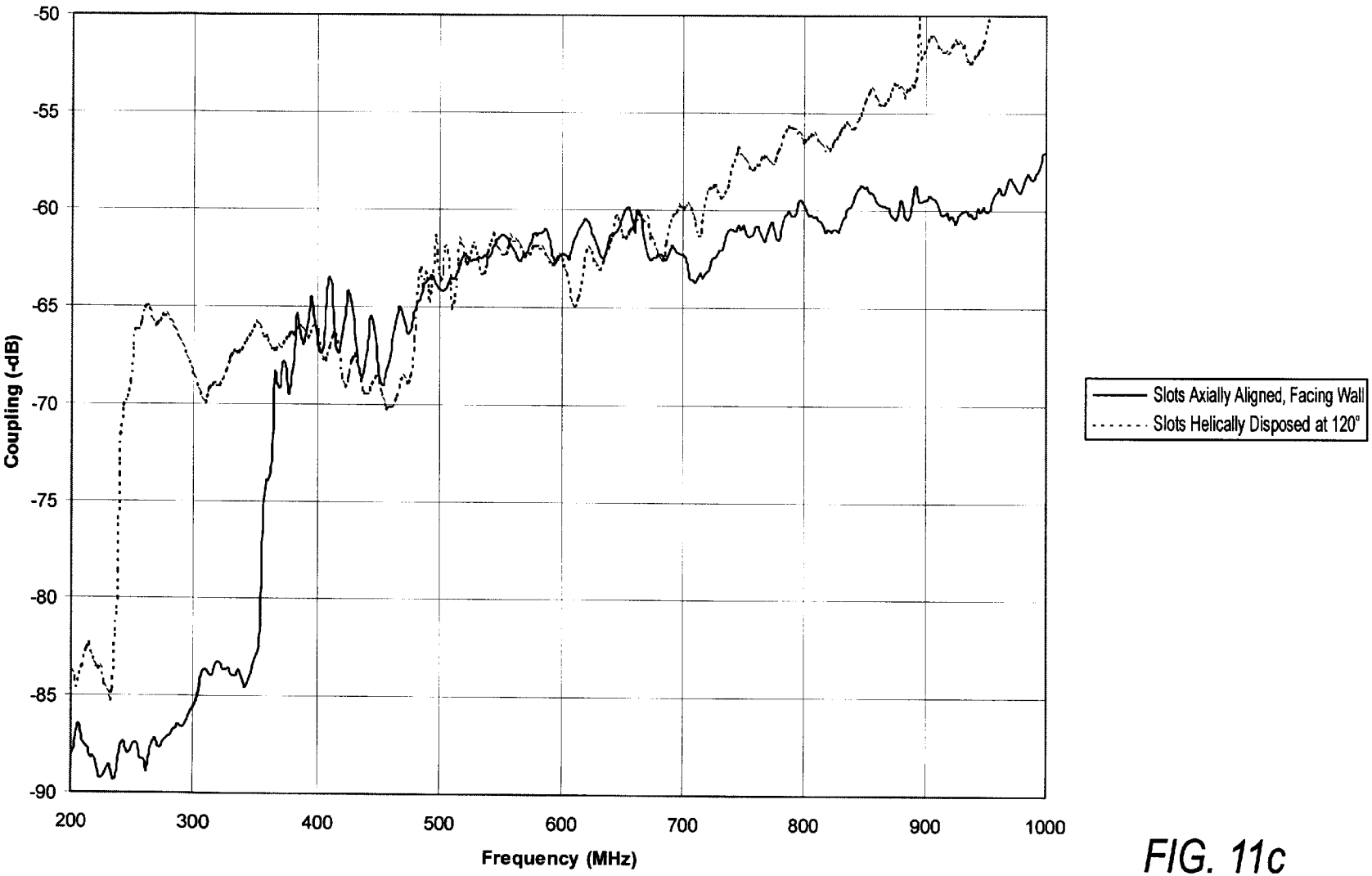
FIG. 11*c* is a comparison of the indoor measurements of the coupling loss (in dB) taken over a frequency range of 200 to 1000 MHz for a radiating coaxial cable having slots such as shown in FIG. 3 but helically disposed at 120° and a cable having axially aligned slots facing inward towards the wall, such as shown in FIG. 1*c*.

Referring to FIG. 10*c*, the coupling loss experienced by the cable of FIG. 3 having slots helically disposed from each other 72° in the circumferential direction is compared to a cable such as shown in FIG. 1*c* having all slots facing outward away from the wall. While the coupling loss of the cable having all slots facing outward is less than the cable having helically disposed slots, examination of FIG. 10*c* indicates the difference in coupling losses is at most 5 dB occurring around 850 MHz. This small difference in coupling loss experienced by the cable having helically disposed slots while receiving a signal is acceptable because this same cable produces a steady near-field signal as seen in FIG. 1*d*. When compared to the case of a cable such as shown in FIG. 1*c* having all slots facing the wall, the cable of FIG. 3 having slots helically disposed from each other 72° in the circumferential direction produces higher coupling as illustrated in FIG 10*d*. Similar results were obtained from a cable having slots helically disposed 120° from each other according to an alternative embodiment of the present invention. FIG. 11*b* compares a cable having slots helically disposed 120° from each other to a cable have axially aligned slots facing outward away from the wall for the same swept frequencies of FIG. 10*c*. FIG. 11*c* compares a cable having slots helically disposed 120° from each other to a cable have axially aligned slots facing inward toward the wall for the same swept frequencies of FIG. 10*d*.

Figure 12A:
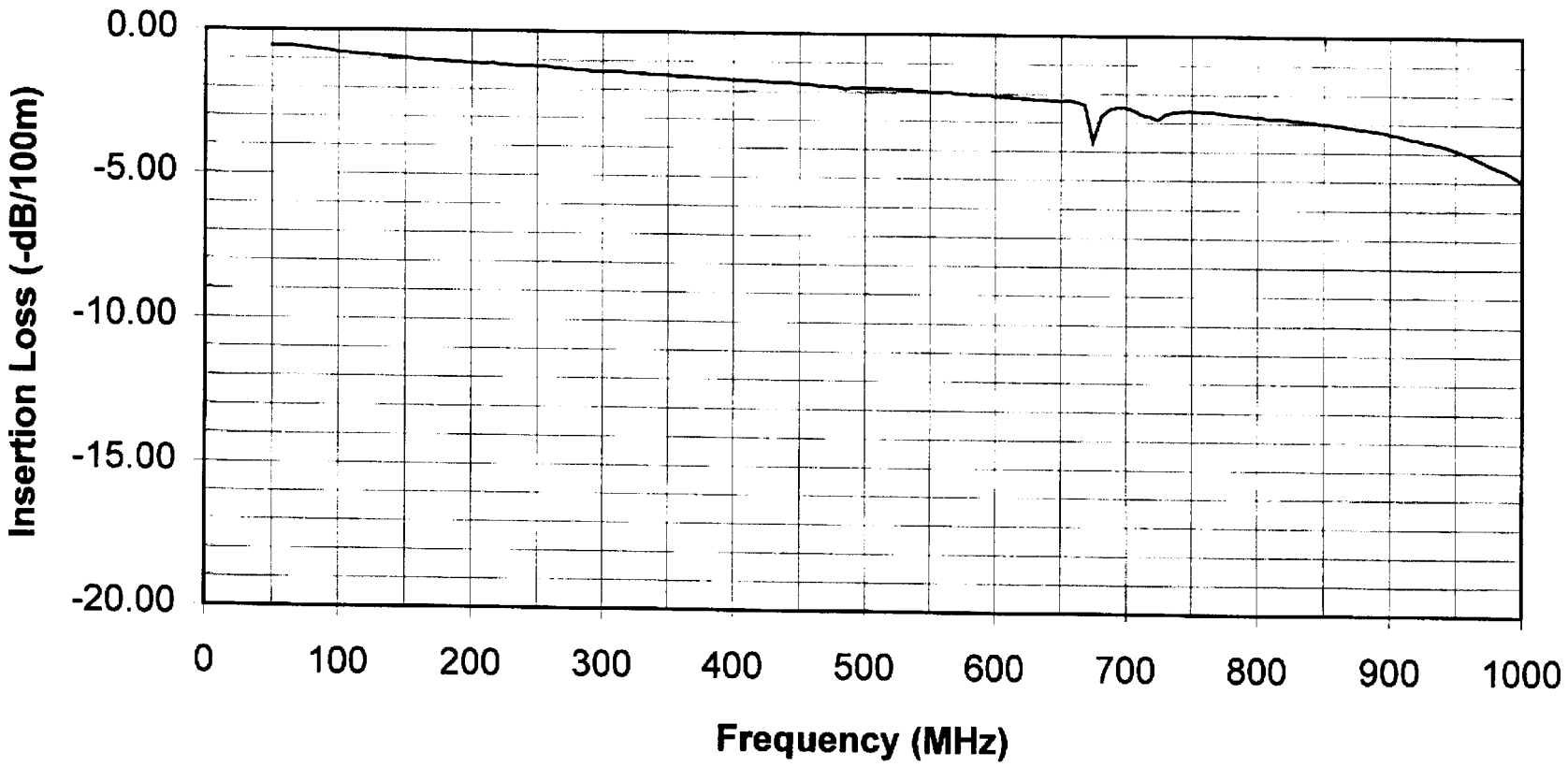
FIG. 12*a* is a plot of the indoor insertion loss (in dB/100 m) of a radiating coaxial cable such as shown in FIG. 3 having slots helically disposed at 72° according to one embodiment of the present invention, measured over a frequency range of 50 to 1000 MHz.
Figure 12B:
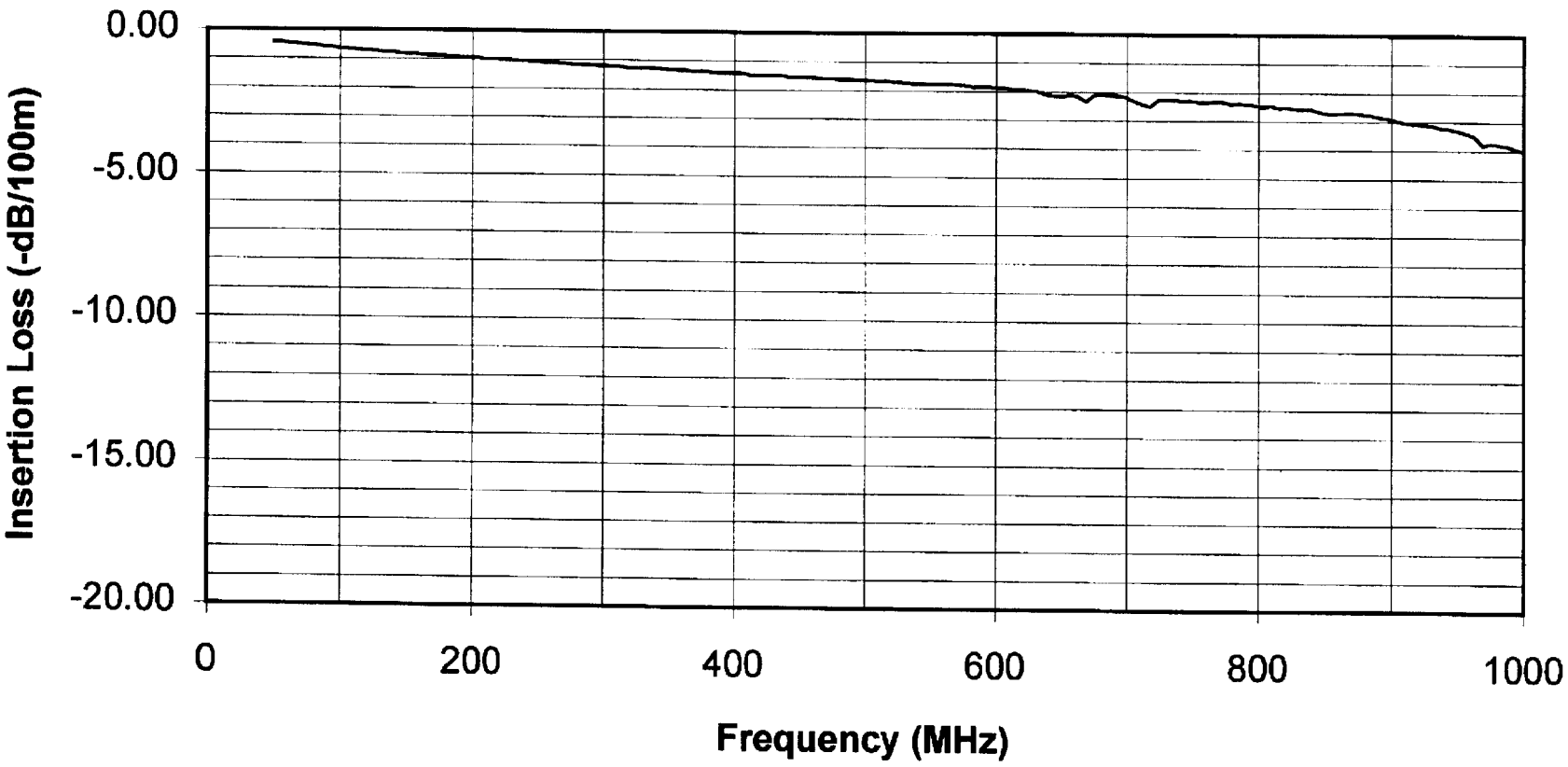
FIG. 12*b* is a plot of the indoor insertion loss in (dB/100 m) of a radiating coaxial cable , such as shown in FIG. 1*c* having axially aligned slots facing outward away from the wall, measured over a frequency range of 50 to 1000 MHz.
Figure 12C:
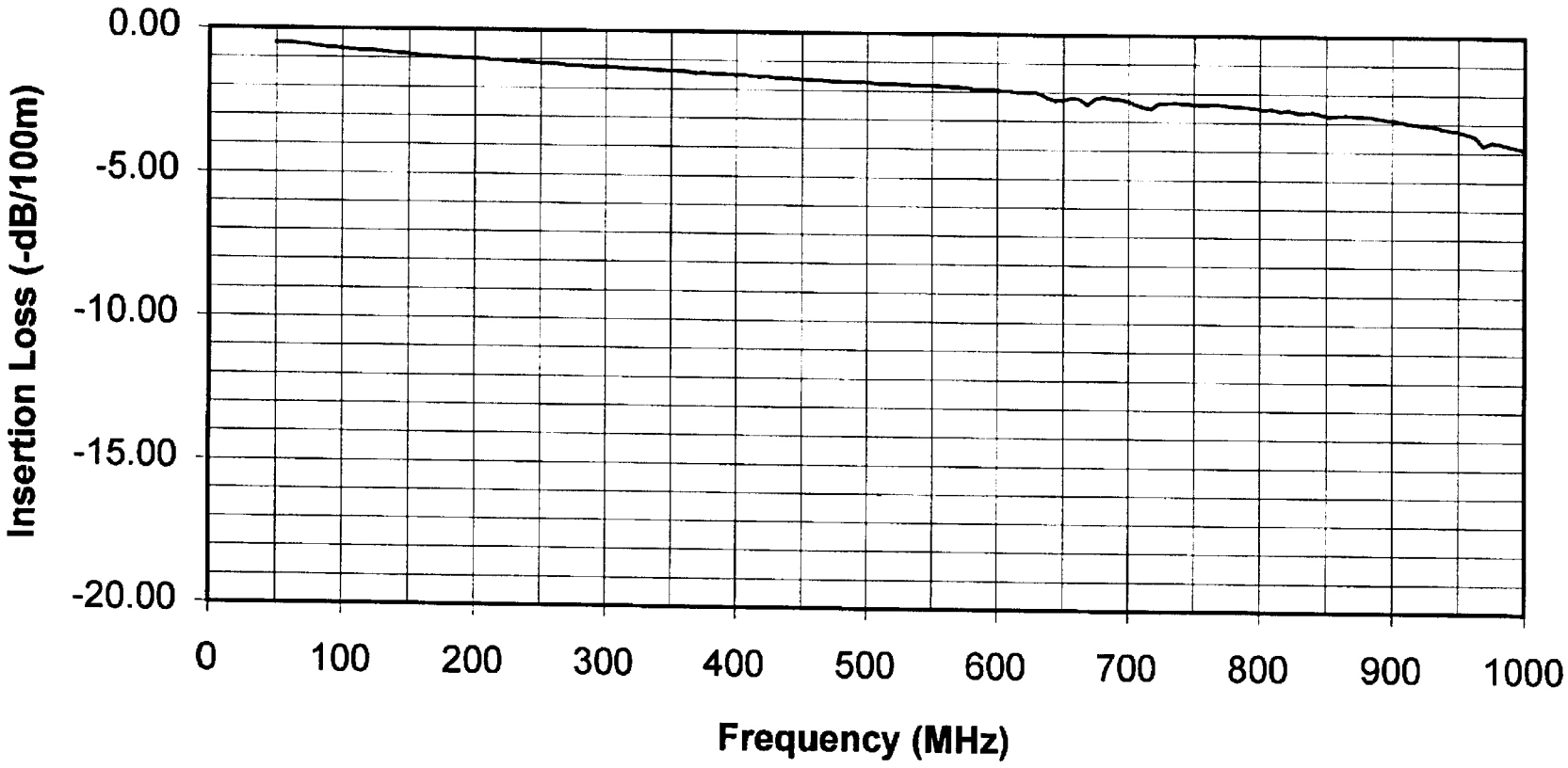
FIG. 12*c* is a plot of the indoor insertion loss (in dB/100 m) of a radiating coaxial cable such as shown in FIG. 1*c* but having slots experiencing a 360° rotation over 180 feet, measured over a frequency range of 50 to 1000 MHz.

Helically disposing the slots of the cable does not have a significant impact on the insertion loss of the cable. Referring to FIGS. 12*a*, 12*b*, and 12*c*, it can been seen that a cable such as shown in FIG. 3 having slots helically disposed from each other (FIG. 12*a* ) has only a slightly higher insertion loss than a cable having all slots facing outward (FIG. 12*b*) and a cable experiencing twisting due to cable reeling (FIG. 12*c* ). This slightly larger cable insertion loss is attributed to the slots not being as compressed because the helically disposed slots are resistant to the aforementioned mechanical compression.

What is claimed is:

1. A radiating coaxial cable having a longitudinal axis comprising:

an inner conductor having a longitudinal axis, the axis of the inner conductor defining the axis of the cable;

a dielectric material surrounding the inner conductor;

a continuous outer conductor surrounding the dielectric in direct contact therewith and spaced from the inner conductor, the outer conductor having a plurality of openings disposed therein, one or more adjacent openings being grouped into a cell, the cable having a plurality of cells, adjacent openings being spaced in the axial direction by a center-to-center axial distance S, the cells being helically disposed in the circumferential direction, adjacent cells being angularly disposed from each other by an angle $\alpha$.

2. The radiating cable of claim 1 wherein $\alpha$ is between approximately 36° and 120°.

3. The radiating cable of claim 2 wherein $\alpha$ is approximately 60°.

4. The radiating cable of claim 2 wherein $\alpha$ is approximately 72°.

5. The radiating cable of claim 2 wherein $\alpha$ is approximately 90°.

6. The radiating cable of claim 2 wherein $\alpha$ is approximately 120°.

7. The radiating cable of claim 1 wherein each of the plurality of openings has elongated edges substantially parallel to the axis of the cable.

8. The radiating cable of claim 1 wherein each of the plurality of openings are zigzag shaped, the zigzag shaped openings further comprising:

a first section having elongated edges substantially parallel to the axis of the cable, the first section also having a first and second end, a second section having elongated edges substantially perpendicular to the axis of the cable, the second section also having a first and second end, the first end of the second section coupled to the second end of the first section, a third section having elongated edges substantially parallel to the axis of the cable, the third section also having a first and second end, the first end of the third section being coupled to the second end of the second section.

9. The radiating cable of claim 1 wherein each of the plurality of openings are elongated and have a longitudinal axis, the longitudinal axis of each opening being tilted with respect to the axis of the cable at an angle ranging between positive 90° and negative 90°.

10. The radiating cable of claim 9 wherein the angle is approximately 30°.

11. The radiating cable of claim 9 wherein the center-to-center axial distance, S, is a maximum of one-fourth the wavelength of a signal propagated through the cable.

12. The radiating cable of claim 1 wherein each of the plurality of openings are elongated and have a longitudinal axis, the longitudinal axis of each opening being tilted with respect to the axis of the cable at an angle ranging between positive 90° and negative 90°, adjacent openings being tilted in alternative positive and negative directions with respect to the axis of the cable.

13. A radiating coaxial cable having a longitudinal axis and adapted for use in communication systems requiring long lengths of cable, the cable comprising:

an elongated smooth-surfaced, cylindrical inner conductor having a longitudinal axis, the axis of the inner conductor defining the axis of the cable;

a dielectric material surrounding the inner conductor;

a continuous outer conductor surrounding the dielectric in direct contact therewith and spaced from the inner conductor;

the outer conductor having a plurality of slots disposed therein, one or more adjacent slots being grouped into a cell, the cable having a plurality of cells, the cells being helically disposed in the circumferential direction, adjacent cells being angularly disposed from each other by an angle α, adjacent slots being dimensioned and spaced to produce a signal having a substantially flat frequency response in the near field along a length of cable when the cable is fed with electromagnetic energy, the slots being spaced from each other by a center-to-center slot axial direction spacing, S.

14. The cable of claim 13 wherein each of the slots have elongated edges and a respective tab comprising an integral part of a respective one of the elongated edges of each slot for coupling energy between a space inside the outer conductor and the slots so that the energy is radiated outside the outer conductor.

15. The cable of claim 13 wherein the elongated edges of the slots are substantially parallel to the axis of the cable.

16. The cable of claim 13 wherein α is between approximately 36° and 120°.

17. The cable of claim 16 wherein a is approximately 72°.

18. The cable of claim 13 wherein each of the plurality of slots are zigzag shaped, the zigzag shaped slots further comprising:

a first section having elongated edges substantially parallel to the axis of the cable, the first section also having a first and second end, a second section having elongated edges substantially perpendicular to the axis of the cable, the second section also having a first and second end, the first end of the second section coupled to the second end of the first section, a third section having elongated edges substantially parallel to the axis of the cable, the third section also having a first and second end, the first end of the third section being coupled to the second end of the second section.

19. The cable of claim 13 wherein each of the plurality of slots are elongated and have a longitudinal axis, the longitudinal axis of each slot being tilted with respect to the axis of the cable at an angle ranging between positive 90° and negative 90°.

20. The cable of claim 19 wherein the magnitude of the angle is approximately 30°.

21. The cable of claim 13 wherein each of the plurality of slots are elongated and have a longitudinal axis, the longitudinal axis of each slot being tilted with respect to the axis of the cable at an angle ranging between positive 90° and negative 90°, adjacent openings being tilted in alternating positive and negative directions with respect to the axis of the cable.

22. The cable of claim 13 wherein the radiated energy produces a near-field, and the dimensions and locations of the slots in the outer conductor produce a substantially flat frequency response in the near field at any point along a length of the cable.

23. The cable of claim 13 wherein the radiated energy produces a near-field, and the dimensions and locations of the slots in the outer conductor are selected to produce a near-field pattern having an amplitude that is substantially constant, at a given frequency, along a length of the cable.

24. A method of communicating among a multiplicity of radio units selected from the group consisting of transmitters, receivers, and transceivers located within a prescribed area, the method comprising:

locating an elongated coaxial cable having a longitudinal axis within or adjacent to the prescribed area for transmitting radiated signals to, and receiving radiated signals from, the multiplicity of radio units along a length of the cable and having a near field encompassing the prescribed area containing the multiplicity of radio units, the cable comprising an elongated smooth-surfaced, cylindrical inner conductor having a longitudinal axis, the axis of the inner conductor defining the axis of the cable, a dielectric material surrounding the inner conductor, a continuous outer conductor surrounding the dielectric in direct contact therewith and spaced from the inner conductor, the outer conductor having disposed therein a plurality of slots, one or more adjacent slots being grouped into a cell, the cable having a plurality of cells, the cells being helically disposed in the circumferential direction, adjacent cells being angularly disposed from each other by an angle α, the slots being located and dimensioned to produce a signal having a substantially flat frequency response in the near field along a length of the cable.

25. The method of claim 24 wherein α is between 36° and 120°.

26. The method of claim 25 wherein α is approximately 72°.

27. The method of claim 24 wherein the each of the plurality of slots are elongated and have a longitudinal axis, the longitudinal axis being tilted with respect to the axis of the cable at an angle having ranging between positive 90° and negative 90°.

28. The method of claim 27 wherein the angle is approximately 30°.

29. The method of claim 24 wherein the each of the plurality of slots are elongated and have a longitudinal axis, the longitudinal axis being tilted with respect to the axis of the cable at an angle having ranging between positive 90° and negative 90°, adjacent openings being tilted in alternating positive and negative directions with respect to the axis of the cable.

30. The method of claim 24 wherein the plurality of openings have elongated edges substantially parallel to the longitudinal axis.

31. The method of claim 24 wherein each of the plurality of slots are zigzag shaped, the zigzag shaped slots further comprising:

a first section having elongated edges substantially parallel to the axis of the cable, the first section also having a first and second end, a second section having elongated edges substantially perpendicular to the axis of the cable, the second section also having a first and second end, the first end of the second section coupled to the second end of the first section, a third section having elongated edges substantially parallel to the axis of the cable, the third section also having a first and second end, the first end of the third section being coupled to the second end of the second section.

32. The method of claim 24 wherein the frequency response produced by the dimensions and locations of the slots in the cable is substantially flat over the bandwidth of the cable.

33. The method of claim 24 wherein the frequency response produced by the dimensions and locations of the slots in the cable is substantially flat over the operating bandwidth of the radio units.

34. The method of claim 24 wherein the cable is at least approximately 60 feet in length.

35. A digital communication system having the capability of two-way transmission of digital signals at high data rates with negligible bit error rates, the system comprising:

a multiplicity of radio units selected from the group consisting of transmitters, receivers, and transceivers located within a prescribed area;

an elongated coaxial cable having a longitudinal axis and located within or adjacent to the prescribed area for transmitting radiated signals to, and receiving radiated signals from, the multiplicity of radio units along a length of the cable, the cable comprising an elongated smooth-surfaced, cylindrical inner conductor having a longitudinal axis, the axis of the inner conductor defining the axis of the cable, a dielectric material surrounding the inner conductor, a continuous outer conductor surrounding the dielectric in direct contact therewith and spaced from the inner conductor, the outer conductor having disposed therein a plurality of slots, one or more adjacent slots being group into a cell, the cable having a plurality of cells, the cells being helically disposed in the circumferential direction, adjacent cells being angular disposed from each other by an angle $\alpha$, the slots being dimensioned and spaced to produce a near field encompassing the prescribed area containing the multiplicity of radio units, and having a near-field pattern having an amplitude that is substantially constant, at a given frequency, along a length of the cable, and wherein the near-field pattern has an amplitude that is substantially constant at a given distance along the cable for the given frequency.

36. The system of claim 35 wherein $\alpha$ is between approximately 36° and 120°.

37. The system of claim 36 wherein $\alpha$ is approximately 72°.

38. The system of claim 35 wherein each of the plurality of slots have elongated edges substantially parallel to the longitudinal axis.

39. The system of claim 35 wherein each of the plurality of slots are zigzag shaped, the zigzag shaped opening further comprising:

a first section having elongated edges substantially parallel to the axis of the cable, the first section also having a first and second end, a second section having elongated edges substantially perpendicular to the axis of the cable, the second section also having a first and second end, the first end of the second section coupled to the second end of the first section, a third section having elongated edges substantially parallel to the axis of the cable, the third section also having a first and second end, the first end of the third section being coupled to the second end of the second section.

40. The system of claim 35 wherein each of the plurality of slots are elongated and have a longitudinal axis, the longitudinal axis of each slot being tilted with respect to the axis of the cable at an angle ranging between positive 90° and negative 90°.

41. The system of claim 40 wherein the angle is approximately 30°.

42. The system of claim 35 wherein each of the plurality of slots are elongated and have a longitudinal axis, the longitudinal axis of each slot being tilted with respect to the axis of the cable at an angle ranging between positive 90° and negative 90°, adjacent openings being tilted in alternating positive and negative directions with respect to the axis of the cable.

43. The system of claim 35 wherein each of the radio units includes a pair of dipole antennas in a space-diversity arrangement.

44. The system of claim 35 wherein the multiplicity of radio units include directive horn antennas for transmitting and receiving the radiated signals.

45. The system of claim 35 wherein the multiplicity of radio units include dipole antennas for transmitting and receiving the radiated signals.

* * * * *